US010107311B2

(12) United States Patent
Takahashi et al.

(10) Patent No.: US 10,107,311 B2
(45) Date of Patent: Oct. 23, 2018

(54) HYDRAULIC DRIVE SYSTEM FOR CONSTRUCTION MACHINE

(71) Applicant: Hitachi Construction Machinery Tierra Co., Ltd., Koka-shi, Shiga (JP)

(72) Inventors: Kiwamu Takahashi, Koka (JP); Yasutaka Tsuruga, Ryugasaki (JP); Yoshifumi Takebayashi, Koka (JP); Kazushige Mori, Koka (JP); Natsuki Nakamura, Koka (JP)

(73) Assignee: Hitachi Construction Machinery Tierra Co., Ltd., Koka-shi (JP)

( * ) Notice: Subject to any disclaimer, the term of this patent is extended or adjusted under 35 U.S.C. 154(b) by 227 days.

(21) Appl. No.: 14/769,922

(22) PCT Filed: Apr. 21, 2014

(86) PCT No.: PCT/JP2014/061205
§ 371 (c)(1),
(2) Date: Aug. 24, 2015

(87) PCT Pub. No.: WO2014/192458
PCT Pub. Date: Dec. 4, 2014

(65) Prior Publication Data
US 2016/0115974 A1 Apr. 28, 2016

(30) Foreign Application Priority Data
May 30, 2013 (JP) ..... 2013-114128

(51) Int. Cl.
*E02F 9/22* (2006.01)
*F15B 11/17* (2006.01)
(Continued)

(52) U.S. Cl.
CPC ..... *F15B 11/17* (2013.01); *E02F 3/325* (2013.01); *E02F 3/425* (2013.01); *E02F 9/2239* (2013.01);
(Continued)

(58) Field of Classification Search
CPC ..... E02F 9/2239; F15B 2211/2654
See application file for complete search history.

(56) References Cited

U.S. PATENT DOCUMENTS 5,029,067 A * 7/1991 Nishida ..... E02F 9/2004 60/421
6,050,090 A * 4/2000 Tohji ..... E02F 9/2203 60/421
(Continued)

FOREIGN PATENT DOCUMENTS

EP 1 905 903 A1 4/2008
EP 2 431 538 A1 3/2012
(Continued)

OTHER PUBLICATIONS

Notification of Transmittal of Translation of the International Preliminary Report on Patentability (Chaper I or Chapter II), in International Application No. PCT/JP2014/061205, dated Dec. 10, 2015.
(Continued)

*Primary Examiner* — F. Daniel Lopez
(74) *Attorney, Agent, or Firm* — Crowell & Moring LLP

(57) ABSTRACT

To cope with a variety of flow rate balance required of two actuators flexibly in combined operations driving two actuators of high maximum demanded flow rates at the same time while suppressing the wasteful energy consumption caused by the throttle pressure loss in a pressure compensating valve, the arrangement is such that when the demanded flow rate of a boom cylinder 3*a* is lower than a prescribed flow
(Continued)

rate, the boom cylinder 3*a* is driven only by hydraulic fluid delivered from a single flow type main pump 202 and when the demanded flow rate of the boom cylinder 3*a* is higher than the prescribed flow rate, the hydraulic fluid delivered from the single flow type main pump 202 and hydraulic fluid delivered from a first delivery port 102*a* of a split flow type main pump 102 are merged together and the boom cylinder 3*a* is driven by the merged fluids. Further, when the demanded flow rate of an arm cylinder 3*b* is lower than a prescribed flow rate, the arm cylinder 3*b* is driven only by hydraulic fluid delivered from a second delivery port 102*b* of the split flow type main pump 102 and when the demanded flow rate of the arm cylinder 3*b* is higher than the prescribed flow rate, hydraulic fluid delivered from the first delivery port 102*a* and hydraulic fluid delivered from the second delivery port 102*b* are merged together and the arm cylinder 3*b* is driven by the merged fluids.

5 Claims, 5 Drawing Sheets

(51) Int. Cl.
*E02F 3/32* (2006.01)
*E02F 3/42* (2006.01)

(52) U.S. Cl.
CPC ..... *E02F 9/2267* (2013.01); *E02F 9/2292* (2013.01); *E02F 9/2296* (2013.01); *F15B 2211/20576* (2013.01); *F15B 2211/20584* (2013.01); *F15B 2211/255* (2013.01); *F15B 2211/2654* (2013.01); *F15B 2211/2656* (2013.01); *F15B 2211/30535* (2013.01); *F15B 2211/30565* (2013.01); *F15B 2211/31535* (2013.01); *F15B 2211/41518* (2013.01); *F15B 2211/465* (2013.01); *F15B 2211/7135* (2013.01); *F15B 2211/7142* (2013.01)

(56) References Cited

U.S. PATENT DOCUMENTS

| | | | | |
|---|---|---|---|---|
| 7,412,827 | B2 * | 8/2008 | Verkuilen | E02F 9/2203 60/428 |
| 2008/0078174 | A1 | 4/2008 | Horii | |
| 2010/0043420 | A1 * | 2/2010 | Ikeda | E02F 9/2239 60/420 |
| 2012/0067443 | A1 * | 3/2012 | Horii | E02F 9/2239 137/599.01 |

FOREIGN PATENT DOCUMENTS

| | | | |
|---|---|---|---|
| EP | 2 977 620 | A1 | 1/2016 |
| JP | 3-260401 | | 11/1991 |
| JP | 2002-206256 | A | 7/2002 |
| JP | 2008-82521 | | 4/2008 |
| JP | 2011-196438 | | 10/2011 |
| JP | 2012-31753 | A | 2/2012 |
| JP | 2012-67459 | | 4/2012 |

OTHER PUBLICATIONS

European Search Report issued in counterpart European Application No. 14804940.6 dated Jan. 25, 2017 (eight pages).

* cited by examiner

HYDRAULIC DRIVE SYSTEM FOR CONSTRUCTION MACHINE

TECHNICAL FIELD

The present invention relates to a hydraulic drive system for a construction machine such as a hydraulic excavator. In particular, the present invention relates to a hydraulic drive system for a construction machine comprising a pump device which has two delivery ports whose delivery flow rates are controlled by a single pump regulator (pump control unit) and a load sensing system which controls delivery pressures of the pump device to be higher than the maximum load pressure of actuators.

BACKGROUND ART

A hydraulic drive system equipped with a load sensing system for controlling the delivery flow rate of a hydraulic pump (main pump) such that the delivery pressure of the hydraulic pump becomes higher by a target differential pressure than the maximum load pressure of a plurality of actuators is widely used today as the hydraulic drive systems for construction machines such as hydraulic excavators.

A hydraulic drive system for a construction machine equipped with such a load sensing system is described in Patent Literature 1, in which a two-pump load sensing system including two hydraulic pumps (first and second hydraulic pumps) corresponding to first and second actuator groups is employed. In the two-pump load sensing system, the maximum displacement of one of the two hydraulic pumps (first hydraulic pump) is set larger than the maximum displacement of the other hydraulic pump (second hydraulic pump). The maximum displacement of the first hydraulic pump is set at a level enough for driving an actuator whose maximum demanded flow rate is the highest (assumed to be an arm cylinder). A specific actuator (assumed to be a boom cylinder) is driven by the delivery flow from the second hydraulic pump. Further, a confluence valve is arranged on the first hydraulic pump's side. Only when the demanded flow rate of the actuator whose maximum demanded flow rate is the highest (assumed to be the arm cylinder) is low, it is made possible to merge the delivery flow from the first hydraulic pump with the delivery flow from the second hydraulic pump via the confluence valve and supply the merged delivery flow to the specific actuator (assumed to be the boom cylinder) when the demanded flow rate of the specific actuator (assumed to be the boom cylinder) is high.

Patent Literature 2 describes a two-pump load sensing system in which a hydraulic pump of the split flow type having two delivery ports is employed instead of two hydraulic pumps. In this system, the delivery flow rates of first and second delivery ports can be controlled independently of each other based respectively on the maximum load pressure of a first actuator group and the maximum load pressure of a second actuator group. Also in this system, a separation/confluence selector valve (travel independent valve) is arranged between the delivery hydraulic lines of the two delivery ports. In cases like performing the traveling only or using the dozer equipment while traveling, the separation/confluence selector valve is switched to a separation position and the delivery flows from the two delivery ports are supplied independently to the actuators. In cases of driving actuators not for the traveling or the dozer (e.g., boom cylinder, arm cylinder, etc.), the separation/confluence selector valve is switched to a confluence position so that the delivery flows from the two delivery ports can be merged together and supplied to the actuators.

PRIOR ART LITERATURE

Patent Literature

Patent Literature 1: JP, A 2011-196438
Patent Literature 1: JP, A 2012-67459

SUMMARY OF THE INVENTION

Problem to be Solved by the Invention

As pointed out in the Patent Literature 1, hydraulic drive systems equipped with an ordinary type of one-pump load sensing system have the following problem: In such a hydraulic drive system equipped with an ordinary type of one-pump load sensing system, the delivery pressure of the hydraulic pump is controlled to be constantly higher than the maximum load pressure of a plurality of actuators by a certain preset pressure. Thus, when an actuator of a high load pressure and an actuator of a low load pressure are driven in combination (e.g., the so-called "level smoothing operation" in which the boom raising (load pressure: high) and the arm crowding (load pressure: low) are performed at the same time), the delivery pressure of the hydraulic pump is controlled to be higher than the high load pressure of the boom cylinder by a certain preset pressure. In this case, a pressure compensating valve for driving the arm cylinder and preventing excessive inflow into the arm cylinder of the low load pressure is throttled, and thus pressure loss in the pressure compensating valve leads to wasteful energy consumption.

In the hydraulic drive system of the Patent Literature 1 comprising the two-pump load sensing system, a hydraulic pump for driving the arm cylinder and a hydraulic pump for driving the boom cylinder are arranged separately. With such arrangement, the throttle pressure loss caused by the pressure compensating valve for driving the arm cylinder of the low load pressure can be reduced in operations like the level smoothing operation and the wasteful energy consumption can be prevented.

However, the two-pump load sensing system described in the Patent Literature 1 has other problems explained below.

In the excavating operation of the hydraulic excavator, the level smoothing operation is implemented by a combination of a low flow rate of the boom cylinder and a high flow rate of the arm cylinder. However, in the hydraulic excavator, both the boom cylinder and the arm cylinder are actuators having higher demanded flow rates compared to the other actuators, and the actual excavating operation of the hydraulic excavator can also include a combined operation in which the boom cylinder has a high flow rate. For example, a bucket scraping operation, in which the arm crowding is performed in a fine operation while performing the boom raising at the maximum speed (boom raising full operation) after the bucket excavation, is implemented by a combination of a high flow rate of the boom cylinder and a low flow rate of the arm cylinder. Further, the so-called oblique pulling operation from the upper side of a slope, in which the main body of the hydraulic excavator is arranged horizontally on the upper side of a slope and then the tip of the bucket is moved obliquely from the downhill side toward the uphill side (upper side) of the slope, is generally implemented by a full input to the arm control lever and a half input to the boom control lever, that is, a combination of an intermediate flow rate of the boom cylinder and a high flow rate of the arm cylinder. In the oblique pulling operation, the lever operation amount of the boom raising changes depending on the angle of the slope and the arm angle with respect to the slope (distance between the vehicle body and the tip end of the bucket), and the flow rate of the boom cylinder changes accordingly between the intermediate flow rate and the high flow rate.

In the Patent Literature 1, the confluence valve is arranged on the first hydraulic pump's side, and only when the demanded flow rate of the arm cylinder is low, it is made possible to merge the delivery flow from the first hydraulic pump with the delivery flow from the second hydraulic pump and supply the merged delivery flow to the boom cylinder when the demanded flow rate of the boom cylinder has increased. However, if the bucket scraping operation after bucket excavation is conducted with such a hydraulic circuit structure, there are cases where the flow rate of the hydraulic fluid supplied to the boom cylinder does not reach a level necessary for quickly performing the bucket scraping operation (slow boom speed).

Further, when the demanded flow rate of the arm cylinder is high, the confluence valve is closed, and thus only the hydraulic fluid from the hydraulic pump on the small displacement side can be supplied to the boom cylinder. As a result, it is impossible to carry out the "oblique pulling operation from the upper side of a slope" in which the demanded flow rate of the boom cylinder increases over the intermediate flow rate.

As explained above, even though the technology of the Patent Literature 1 is capable of achieving appropriate flow rate balance required of the boom cylinder and the arm cylinder for a specific combined operation such as level smoothing operation, the technology involves a problem in that the required flow rate balance cannot be achieved for combined operations in which a flow rate over the intermediate flow rate is demanded by the boom cylinder and such combined operations cannot be performed appropriately or at all.

In the load sensing system described in the Patent Literature 2, in cases other than the traveling or the use of the dozer equipment, the actuators are driven by merging together the delivery flows from the two delivery ports, and thus the hydraulic circuit geometry in such cases is practically identical with that of the one-pump hydraulic circuit. Therefore, similarly to the hydraulic drive system equipped with the ordinary type of one-pump load sensing system, the technology of the Patent Literature 2 has a fundamental problem in that wasteful energy consumption is caused by pressure loss in a pressure compensating valve in combined operations in which an actuator of a high load pressure and an actuator of a low load pressure are driven in combination.

The object of the present invention is to provide a hydraulic drive system for a construction machine in which in combined operations driving two actuators of high maximum demanded flow rates at the same time, while suppressing the wasteful energy consumption caused by the throttle pressure loss in a pressure compensating valve, a variety of flow rate balance required of two actuators can be coped with flexibly.

Means for Solving the Problem (1) To achieve the above object, the present invention provides a hydraulic drive system for a construction machine, comprising: a first pump device of a split flow type having a first delivery port and a second delivery port; a second pump device of a single flow type having a third delivery port; a plurality of actuators which are driven by hydraulic fluid delivered from the first through third delivery ports of the first and second pump devices; a plurality of flow control valves which control the flow of the hydraulic fluid supplied from the first through third delivery ports to the actuators; a plurality of pressure compensating valves each of which controls the differential pressure across each of the flow control valves; a first pump control unit including a first load sensing control unit which controls the displacement of the first pump device such that the delivery pressure of the high pressure side of the first and second delivery ports becomes higher by a target differential pressure than the maximum load pressure of the actuators driven by the hydraulic fluid delivered from the first and second delivery ports; and a second pump control unit including a second load sensing control unit which controls the displacement of the second pump device such that the delivery pressure of the third delivery port becomes higher by a target differential pressure than the maximum load pressure of the actuators driven by the hydraulic fluid delivered from the third delivery port. The plurality of actuators include first and second actuators whose maximum demanded flow rates are higher compared to the other actuators. The first delivery port of the first pump device and the third delivery port of the second pump device are connected to the first actuator in such a manner that the first actuator is driven only by the hydraulic fluid delivered from the third delivery port of the single flow type second pump device when the demanded flow rate of the first actuator is lower than a prescribed flow rate and the first actuator is driven by the hydraulic fluid delivered from the third delivery port of the single flow type second pump device and the hydraulic fluid delivered from one of the first and second delivery ports of the split flow type first pump device merged together when the demanded flow rate of the first actuator is higher than the prescribed flow rate. The first and second delivery ports of the first pump device are connected to the second actuator in such a manner that the second actuator is driven only by the hydraulic fluid delivered from the other one of the first and second delivery ports of the split flow type first pump device when the demanded flow rate of the second actuator is lower than a prescribed flow rate and the second actuator is driven by the hydraulic fluids delivered from the first and second delivery ports of the split flow type first pump device merged together when the demanded flow rate of the second actuator is higher than the prescribed flow rate.

According to the present invention configured as above, in combined operations in which the demanded flow rate of the first actuator (e.g., boom cylinder) is low and the demanded flow rate of the second actuator (e.g., arm cylinder) is high (e.g., level smoothing operation), the hydraulic fluid at the high flow rate demanded by the second actuator is supplied to the second actuator from the first and second delivery ports. In combined operations in which the demanded flow rate of the first actuator (e.g., boom cylinder) is high and the demanded flow rate of the second actuator (e.g., arm cylinder) is low (e.g., bucket scraping operation), the hydraulic fluid at the high flow rate demanded by the first actuator is supplied to the first actuator from the first and third delivery ports. In combined operations in which the demanded flow rate of the first actuator (e.g., boom cylinder) is intermediate or higher and the demanded flow rate of the second actuator (e.g., arm cylinder) is high (e.g., oblique pulling operation from the upper side of a slope), the hydraulic fluid at the intermediate or higher flow rate demanded by the first actuator is supplied to the first actuator from the first and third delivery ports and the hydraulic fluid at the high flow rate demanded by the second actuator is supplied to the second actuator from the first and second delivery ports.

As above, in combined operations driving two actuators of high maximum demanded flow rates at the same time, a variety of flow rate balance required of the two actuators can be coped with flexibly.

Further, in combined operations other than those in which both of the demanded flow rates of the first and second actuators reach the intermediate flow rate or higher, the first and second actuators are driven by hydraulic fluid delivered from separate delivery ports. Also in the combined operations in which both of the demanded flow rates of the first and second actuators reach the intermediate flow rate or higher, the first and second actuators are driven by hydraulic fluid delivered from separate delivery ports at least in regard to the second and third delivery ports. Therefore, the wasteful energy consumption caused by the throttle pressure loss in the pressure compensating valve for the actuator on the low load pressure side can be suppressed.

(2) Preferably, in the above hydraulic drive system (1) for a construction machine, the split flow type first pump device is configured to deliver the hydraulic fluid from the first and second delivery ports at flow rates equal to each other. The plurality of actuators include third and fourth actuators driven at the same time and achieving a prescribed function by having supply flow rates equivalent to each other when driven at the same time. The first and second delivery ports of the first pump device are connected to the third and fourth actuators in such a manner that the third actuator is driven by the hydraulic fluid delivered from one of the first and second delivery ports of the split flow type first pump device and the fourth actuator is driven by the hydraulic fluid delivered from the other one of the first and second delivery ports of the split flow type first pump device.

With such features, equal flow rates of hydraulic fluid are delivered from the first and second delivery ports to their respective hydraulic fluid supply lines, the third and fourth actuators (e.g., left and right travel motors) are constantly supplied with equal amounts of hydraulic fluid, and the prescribed function can be achieved by the third and fourth actuators with reliability.

(3) Preferably, in the above hydraulic drive system (2) for a construction machine, the first pump control unit includes a first torque control actuator to which the delivery pressure of the first delivery port of the split flow type first pump device is led and a second torque control actuator to which the delivery pressure of the second delivery port of the split flow type first pump device is led whereby the first pump control unit decreases the displacement of the first pump device with the increase in the average pressure of the delivery pressures of the first and second delivery ports.

With such features, the possibility of flow rate limitation by the torque control (power control) decreases in comparison with cases where the third and fourth actuators (e.g., left and right travel motors) are driven by one pump. Consequently, the prescribed function (e.g., travel steering) can be achieved by the third and fourth actuators with no major deterioration in the working efficiency.

(4) Preferably, the above hydraulic drive system (2) or (3) for a construction machine further comprises a selector valve which is connected between a first hydraulic fluid supply line connected to the first delivery port of the split flow type first pump device and a second hydraulic fluid supply line connected to the second delivery port of the split flow type first pump device and is switched to a communication position when the third and fourth actuators and another actuator driven by the split flow type first pump device are driven at the same time and to an interruption position at the other time.

With such features, the first and second delivery ports of the first pump device function as one pump in combined operations in which the third and fourth actuators (e.g., left and right travel motors) and another actuator are driven at the same time (e.g., travel combined operation). Accordingly, the hydraulic fluid can be supplied to the third and fourth actuators and another actuator at necessary flow rates and excellent operability in the combined operation can be achieved.

(5) Preferably, in the above hydraulic drive system (1) for a construction machine, the plurality of flow control valves include a first flow control valve which is arranged in a hydraulic line connecting a third hydraulic fluid supply line connected to the third delivery port of the second pump device to the first actuator, a second flow control valve which is arranged in a hydraulic line connecting a first hydraulic fluid supply line connected to the first delivery port of the first pump device to the first actuator, a third flow control valve which is arranged in a hydraulic line connecting a second hydraulic fluid supply line connected to the second delivery port of the first pump device to the second actuator, and a fourth flow control valve which is arranged in a hydraulic line connecting the first hydraulic fluid supply line connected to the first delivery port of the first pump device to the second actuator. The first and third flow control valves each have an opening area characteristic set such that the opening area increases with the increase in the spool stroke, the opening area reaches a maximum opening area at an intermediate stroke and thereafter the maximum opening area is maintained until the spool stroke reaches a maximum spool stroke. The second and fourth flow control valves each have an opening area characteristic set such that the opening area remains at 0 until the spool stroke reaches an intermediate stroke, increases with the increase in the spool stroke beyond the intermediate stroke and reaches a maximum opening area just before the spool stroke reaches a maximum spool stroke.

With such features, the connecting structures of the first through third delivery ports and the first and second actuators described in the paragraph of the above hydraulic drive system (1) (the first delivery port of the first pump device and the third delivery port of the second pump device are connected to the first actuator in such a manner that the first actuator is driven only by the hydraulic fluid delivered from the third delivery port of the single flow type second pump device when the demanded flow rate of the first actuator is lower than a prescribed flow rate and the first actuator is driven by the hydraulic fluid delivered from the third delivery port of the single flow type second pump device and the hydraulic fluid delivered from one of the first and second delivery ports of the split flow type first pump device merged together when the demanded flow rate of the first actuator is higher than the prescribed flow rate, and the first and second delivery ports of the first pump device are connected to the second actuator in such a manner that the second actuator is driven only by the hydraulic fluid delivered from the other one of the first and second delivery ports of the split flow type first pump device when the demanded flow rate of the second actuator is lower than a prescribed flow rate and the second actuator is driven by the hydraulic fluids delivered from the first and second delivery ports of the split flow type first pump device merged together when the demanded flow rate of the second actuator is higher than the prescribed flow rate) can be implemented.

(6) For example, in any one of the above hydraulic drive systems (1)-(5) for a construction machine, the first and second actuators are a boom cylinder and an arm cylinder for driving a boom and an arm of a hydraulic excavator.

With such features, in combined operations driving the boom cylinder and the arm cylinder of the hydraulic excavator at the same time, while suppressing the wasteful energy consumption caused by the throttle pressure loss in a pressure compensating valve, a variety of flow rate balance required of the boom cylinder and the arm cylinder can be coped with flexibly and excellent operability in the combined operation can be achieved.

(7) For example, in any one of the above hydraulic drive systems (2)-(6) for a construction machine, the third and fourth actuators are left and right travel motors for driving a track structure of a hydraulic excavator.

With such features, an excellent straight traveling property can be achieved in the hydraulic excavator. Further, excellent steering feel can be realized in the travel steering operation of the hydraulic excavator.

Effect of the Invention

According to the present invention, in combined operations driving two actuators of high maximum demanded flow rates at the same time, while suppressing the wasteful energy consumption caused by the throttle pressure loss in a pressure compensating valve, a variety of flow rate balance required of the two actuators can be coped with flexibly and excellent operability in the combined operation can be achieved.

In combined operations driving the boom cylinder and the arm cylinder of a hydraulic excavator at the same time, while suppressing the wasteful energy consumption caused by the throttle pressure loss in a pressure compensating valve, a variety of flow rate balance required of the boom cylinder and the arm cylinder can be coped with flexibly and excellent operability in the combined operation can be achieved.

Further, an excellent straight traveling property of a hydraulic excavator can be achieved. Furthermore, excellent steering feel can be realized in the travel steering operation of the hydraulic excavator.

MODE FOR CARRYING OUT THE INVENTION

Figure 1:
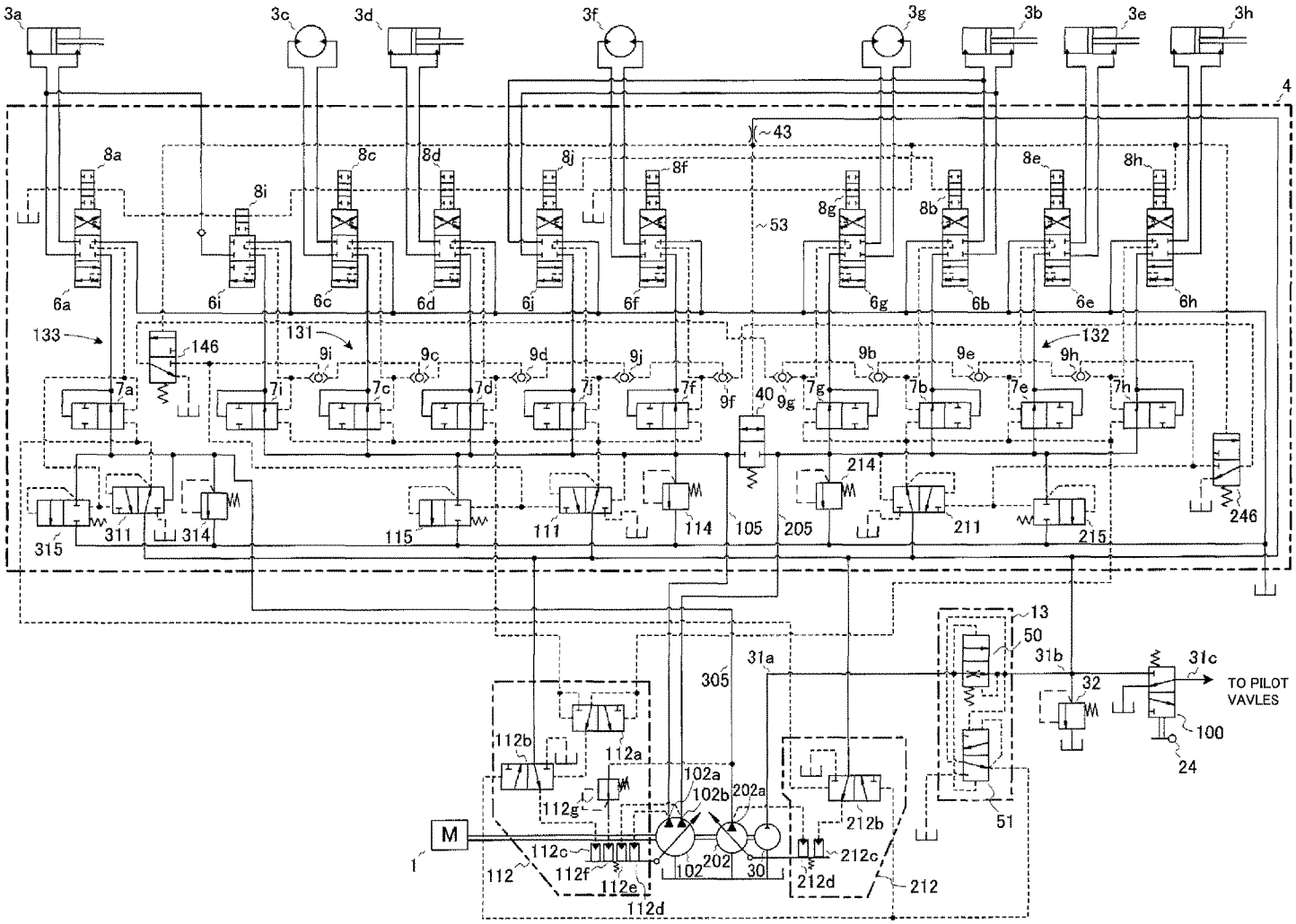
FIG. 1 is a schematic diagram showing a hydraulic drive system for a hydraulic excavator (construction machine) in accordance with a first embodiment of the present invention.

Referring now to the drawings, a description will be given in detail of preferred embodiments of the present invention.

First Embodiment

Structure

FIG. 1 is a schematic diagram showing a hydraulic drive system for a hydraulic excavator (construction machine) in accordance with a first embodiment of the present invention.

Referring to FIG. 1, the hydraulic drive system according to this embodiment comprises a prime mover 1, a main pump 102 (first pump device), a main pump 202 (second pump device), actuators 3*a*, 3*b*, 3*c*, 3*d*, 3*e*, 3*f*, 3*g* and 3*h*, a control valve unit 4, a regulator 112 (first pump control unit), and a regulator 212 (second pump control unit). The main pumps 102 and 202 are driven by the prime mover 1 (e.g., diesel engine). The main pump 102 (first pump device) is a variable displacement pump of the split flow type having first and second delivery ports 102*a* and 102*b* for delivering the hydraulic fluid to first and second hydraulic fluid supply lines 105 and 205. The main pump 202 (second pump device) is a variable displacement pump of the single flow type having a third delivery port 202*a* for delivering the hydraulic fluid to a third hydraulic fluid supply line 305. The actuators 3*a*, 3*b*, 3*c*, 3*d*, 3*e*, 3*f*, 3*g* and 3*h* are driven by the hydraulic fluid delivered from the first and second delivery ports 102*a* and 102*b* of the main pump 102 and the third delivery port 202*a* of the main pump 202. The control valve unit 4 is connected to the first through third hydraulic fluid supply lines 105, 205 and 305 and controls the flow of the hydraulic fluid supplied from the first and second delivery ports 102*a* and 102*b* of the main pump 102 and the third delivery port 202*a* of the main pump 202 to the actuators 3*a*, 3*b*, 3*c*, 3*d*, 3*e*, 3*f*, 3*g* and 3*h*. The regulator 112 (first pump control unit) is used for controlling the delivery flow rates of the first and second delivery ports 102*a* and 102*b* of the main pump 102. The regulator 212 (second pump control unit) is used for controlling the delivery flow rate of the third delivery port 202*a* of the main pump 202.

The control valve unit 4 includes flow control valves 6*a*, 6*b*, 6*c*, 6*d*, 6*e*, 6*f*, 6*g*, 6*h*, 6*i* and 6*j*, pressure compensating valves 7*a*, 7*b*, 7*c*, 7*d*, 7*e*, 7*f*, 7*g*, 7*h*, 7*i* and 7*j*, operation detection valves 8*a*, 8*b*, 8*c*, 8*d*, 8*e*, 8*f*, 8*g*, 8*h*, 8*i* and 8*j*, main relief valves 114, 214 and 314, and unload valves 115, 215 and 315. The flow control valves 6*a*, 6*b*, 6*c*, 6*d*, 6*e*, 6*f*, 6*g*, 6*h*, 6*i* and 6*j* are connected to the first through third hydraulic fluid supply lines 105, 205 and 305 and control the flow rates of the hydraulic fluid supplied to the actuators 3*a*-3*h* from the first and second delivery ports 102*a* and 102*b* of the main pump 102 and the third delivery port 202*a* of the main pump 202. Each pressure compensating valve 7*a*-7*j* controls the differential pressure across each flow control valve 6*a*-6*j* such that the differential pressure becomes equal to a target differential pressure. Each operation detection valve 8*a*-8*j* strokes together with the spool of each flow control valve 6*a*-6*j* in order to detect the switching of each flow control valve. The main relief valve 114 is connected to the first hydraulic fluid supply line 105 and controls the pressure in the first hydraulic fluid supply line 105 such that the pressure does not reach a preset pressure. The main relief valve 214 is connected to the second hydraulic fluid supply line 205 and controls the pressure in the second hydraulic fluid supply line 205 such that the pressure does not reach a preset pressure. The main relief valve 314 is connected to the third hydraulic fluid supply line 305 and controls the pressure in the third hydraulic fluid supply line 305 such that the pressure does not reach a preset pressure. The unload valve 115 is connected to the first hydraulic fluid supply line 105. When the pressure in the first hydraulic fluid supply line 105 becomes higher than a pressure (unload valve set pressure) defined as the sum of the maximum load pressure of the actuators driven by the hydraulic fluid delivered from the first delivery port 102*a* and a preset pressure (prescribed pressure) of its own spring, the unload valve 115 shifts to the open state and returns the hydraulic fluid in the first hydraulic fluid supply line 105 to a tank. The unload valve 215 is connected to the second hydraulic fluid supply line 205. When the pressure in the second hydraulic fluid supply line 205 becomes higher than a pressure (unload valve set pressure) defined as the sum of the maximum load pressure of the actuators driven by the hydraulic fluid delivered from the second delivery port 102*b* and a preset pressure (prescribed pressure) of its own spring, the unload valve 215 shifts to the open state and returns the hydraulic fluid in the second hydraulic fluid supply line 205 to the tank. The unload valve 215 is connected to the third hydraulic fluid supply line 305. When the pressure in the third hydraulic fluid supply line 305 becomes higher than a pressure (unload valve set pressure) defined as the sum of the maximum load pressure of the actuators driven by the hydraulic fluid delivered from the third delivery port 202*a* and a preset pressure (prescribed pressure) of its own spring, the unload valve 315 shifts to the open state and returns the hydraulic fluid in the third hydraulic fluid supply line 305 to the tank.

The control valve unit 4 further includes a first load pressure detection circuit 131, a second load pressure detection circuit 132, a third load pressure detection circuit 133, and differential pressure reducing valves 111, 211 and 311. The first load pressure detection circuit 131 includes shuttle valves 9*c*, 9*d*, 9*f*, 9*i* and 9*j* which are connected to load ports of the flow control valves 6*c*, 6*d*, 6*f*, 6*i* and 6*j* connected to the first hydraulic fluid supply line 105 in order to detect the maximum load pressure Plmax1 of the actuators 3*a*, 3*b*, 3*c*, 3*d* and 3*f*. The second load pressure detection circuit 132 includes shuttle valves 9*b*, 9*e*, 9*g* and 9*h* which are connected to load ports of the flow control valves 6*b*, 6*e*, 6*g* and 6*h* connected to the second hydraulic fluid supply line 205 in order to detect the maximum load pressure Plmax2 of the actuators 3*b*, 3*e*, 3*g* and 3*h*. The third load pressure detection circuit 133 is connected to the load port of the flow control valve 6*a* connected to the third hydraulic fluid supply line 305 in order to detect the load pressure (maximum load pressure) Plmax3 of the actuator 3*a*. The differential pressure reducing valve 111 outputs the difference (LS differential pressure) between the pressure P1 in the first hydraulic fluid supply line 105 (i.e., pump pressure in the first delivery port 102*a*) and the maximum load pressure Plmax1 detected by the first load pressure detection circuit 131 (i.e., maximum load pressure of the actuators 3*a*, 3*b*, 3*c*, 3*d* and 3*f* connected to the first hydraulic fluid supply line 105) as absolute pressure Pls1. The differential pressure reducing valve 211 outputs the difference (LS differential pressure) between the pressure P2 in the second hydraulic fluid supply line 205 (i.e., pump pressure in the second delivery port 102*b*) and the maximum load pressure Plmax2 detected by the second load pressure detection circuit 132 (i.e., maximum load pressure of the actuators 3*b*, 3*e*, 3*g* and 3*h* connected to the second hydraulic fluid supply line 205) as absolute pressure Pls2. The differential pressure reducing valve 311 outputs the difference (LS differential pressure) between the pressure P3 in the third hydraulic fluid supply line 305 (i.e., pump pressure in the third delivery port 202*a*) and the maximum load pressure Plmax3 detected by the third load pressure detection circuit 133 (i.e., load pressure of the actuator 3*a* (boom cylinder 3*a* in the illustrated embodiment) connected to the third hydraulic fluid supply line 305) as absolute pressure Pls3.

To the aforementioned unload valve 115, the maximum load pressure Plmax1 detected by the first load pressure detection circuit 131 (as the maximum load pressure of the actuators driven by the hydraulic fluid delivered from the first delivery port 102*a*) is led. To the aforementioned unload valve 215, the maximum load pressure Plmax2 detected by the second load pressure detection circuit 132 (as the maximum load pressure of the actuators driven by the hydraulic fluid delivered from the second delivery port 102*b*) is led. To the aforementioned unload valve 315, the maximum load pressure Plmax3 detected by the third load pressure detection circuit 133 (as the maximum load pressure of the actuator(s) driven by the hydraulic fluid delivered from the third delivery port 202*a*) is led.

The LS differential pressure outputted by the differential pressure reducing valve 111 (absolute pressure Pls1) is led to the pressure compensating valves 7*c*, 7*d*, 7*f*, 7*i* and 7*j* connected to the first hydraulic fluid supply line 105 and to the regulator 112 of the main pump 102. The LS differential pressure outputted by the differential pressure reducing valve 211 (absolute pressure Pls2) is led to the pressure compensating valves 7*b*, 7*e*, 7*g* and 7*h* connected to the second hydraulic fluid supply line 205 and to the regulator 112 of the main pump 102. The LS differential pressure outputted by the differential pressure reducing valve 311 (absolute pressure Pls3) is led to the pressure compensating valve 7*a* connected to the third hydraulic fluid supply line 305 and to the regulator 212 of the main pump 202.

The actuator 3*a* is connected to the first delivery port 102*a* via the flow control valve 6*i*, the pressure compensating valve 7*i* and the first hydraulic fluid supply line 105, and to the third delivery port 202*a* via the flow control valve 6*a*, the pressure compensating valve 7*a* and the third hydraulic fluid supply line 305. The actuator 3*a* is a boom cylinder for driving a boom of the hydraulic excavator, for example. The flow control valve 6*a* is used for the main driving of the boom cylinder 3*a*, while the flow control valve 6*i* is used for the assist driving of the boom cylinder 3*a*. The actuator 3*b* is connected to the first delivery port 102*a* via the flow control valve 6*j*, the pressure compensating valve 7*j* and the first hydraulic fluid supply line 105, and to the second delivery port 102*b* via the flow control valve 6*b*, the pressure compensating valve 7*b* and the second hydraulic fluid supply line 205. The actuator 3*b* is an arm cylinder for driving an arm of the hydraulic excavator, for example. The flow control valve 6*b* is used for the main driving of the arm cylinder 3*b*, while the flow control valve 6*j* is used for the assist driving of the arm cylinder 3*b*.

The actuators 3*c*, 3*d* and 3*f* are connected to the first delivery port 102*a* via the flow control valves 6*c*, 6*d* and 6*f*, the pressure compensating valves 7*c*, 7*d* and 7*f* and the first hydraulic fluid supply line 105, respectively. The actuators 3*g*, 3*e* and 3*h* are connected to the second delivery port 102*b* via the flow control valves 6*g*, 6*e* and 6*h*, the pressure compensating valves 7*g*, 7*e* and 7*h* and the second hydraulic fluid supply line 205, respectively. The actuators 3*c*, 3*d* and 3*f* are, for example, a swing motor for driving an upper swing structure of the hydraulic excavator, a bucket cylinder for driving a bucket of the hydraulic excavator, and a left travel motor for driving a left crawler of a lower track structure of the hydraulic excavator, respectively. The actuators 3*g*, 3*e* and 3*h* are, for example, a right travel motor for driving a right crawler of the lower track structure of the hydraulic excavator, a swing cylinder for driving a swing post of the hydraulic excavator, and a blade cylinder for driving a blade of the hydraulic excavator, respectively.

The control valve 4 further includes a travel combined operation detection hydraulic line 53, a first selector valve 40, a second selector valve 146, and a third selector valve 246. The travel combined operation detection hydraulic line 53 is a hydraulic line whose upstream side is connected to a pilot hydraulic fluid supply line 31*b* (explained later) via a restrictor 43 and whose downstream side is connected to the tank via the operation detection valves 8*a*-8*j*. The first selector valve 40, the second selector valve 146 and the third selector valve 246 are switched according to an operation detection pressure generated by the travel combined operation detection hydraulic line 53.

When a travel combined operation (driving the left travel motor 3*f* and/or the right travel motor 3*g* and at least one of the other actuators at the same time) is not performed, the travel combined operation detection hydraulic line 53 is connected to the tank via at least one of the operation detection valves 8*a*-8*j*, by which the pressure in the hydraulic line becomes equal to the tank pressure. When the travel combined operation is performed, the operation detection valves 8*f* and 8*g* and at least one of the operation detection valves 8*a*-8*j* stroke together with corresponding flow control valves and the communication of the travel combined operation detection hydraulic line 53 with the tank is interrupted, by which the operation detection pressure (operation detection signal) is generated in the travel combined operation detection hydraulic line 53.

When the travel combined operation is not performed, the first selector valve 40 is positioned at a first position (interruption position) as the lower position in FIG. 1 and interrupts the communication between the first hydraulic fluid supply line 105 and the second hydraulic fluid supply line 205. When the travel combined operation is performed, the first selector valve 40 is switched to a second position (communication position) as the upper position in FIG. 1 by the operation detection pressure generated in the travel combined operation detection hydraulic line 53 and brings the first hydraulic fluid supply line 105 and the second hydraulic fluid supply line 205 into communication with each other.

When the travel combined operation is not performed, the second selector valve 146 is positioned at a first position (lower position in FIG. 1) and leads the tank pressure to the shuttle valve 9*g* at the downstream end of the second load pressure detection circuit 132. When the travel combined operation is performed, the second selector valve 146 is switched to a second position (upper position in FIG. 1) by the operation detection pressure generated in the travel combined operation detection hydraulic line 53 and leads the maximum load pressure Plmax1 detected by the first load pressure detection circuit 131 (maximum load pressure of the actuators 3*a*, 3*b*, 3*c*, 3*d* and 3*f* connected to the first hydraulic fluid supply line 105) to the shuttle valve 9*g* at the downstream end of the second load pressure detection circuit 132.

When the travel combined operation is not performed, the third selector valve 246 is positioned at a first position (lower position in FIG. 1) and leads the tank pressure to the shuttle valve 9*f* at the downstream end of the first load pressure detection circuit 131. When the travel combined operation is performed, the third selector valve 246 is switched to a second position (upper position in FIG. 1) by the operation detection pressure generated in the travel combined operation detection hydraulic line 53 and leads the maximum load pressure Plmax2 detected by the second load pressure detection circuit 132 (maximum load pressure of the actuators 3*b*, 3*e*, 3*g* and 3*h* connected to the second hydraulic fluid supply line 205) to the shuttle valve 9*f* at the downstream end of the first load pressure detection circuit 131.

Figure 3:
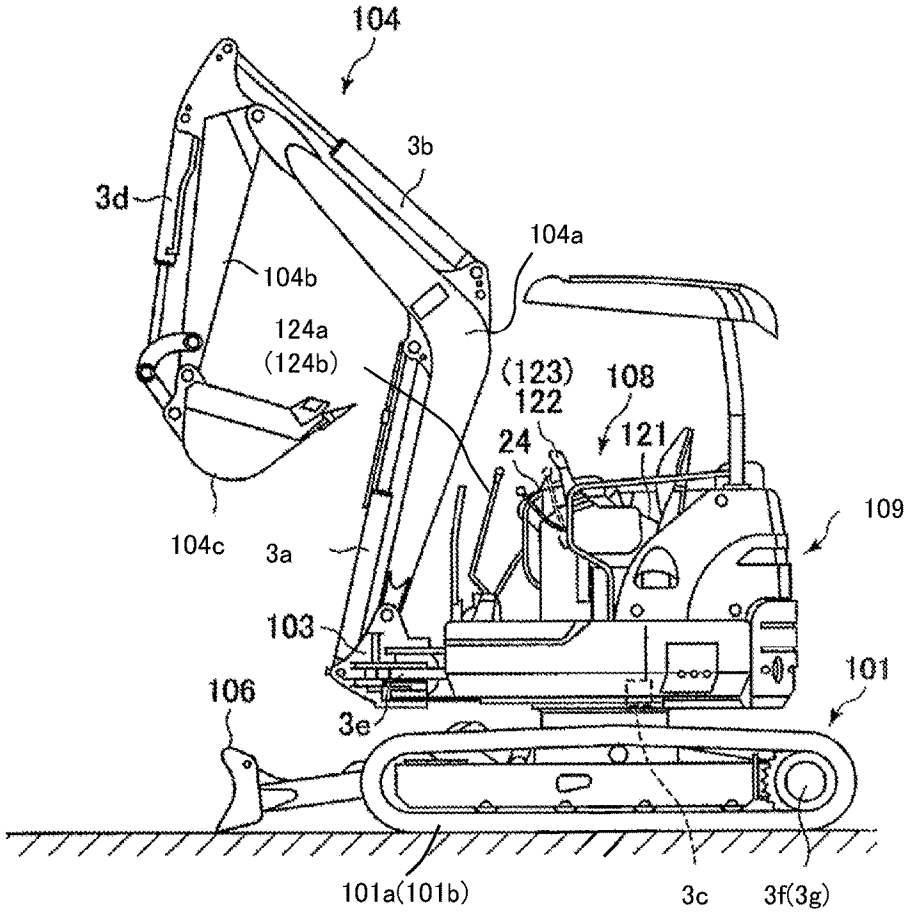
FIG. 3 is a schematic diagram showing the external appearance of a hydraulic excavator as the construction machine in which the hydraulic drive system according to the present invention is installed.

The hydraulic drive system in this embodiment further comprises a pilot pump 30, a prime mover revolution speed detection valve 13, a pilot relief valve 32, a gate lock valve 100, and operating devices 122, 123, 124*a* and 124*b* (FIG. 3). The pilot pump 30 is a fixed displacement pump that is driven by the prime mover 1. The prime mover revolution speed detection valve 13 is connected to a hydraulic fluid supply line 31*a* of the pilot pump 30 and detects the delivery flow rate of the pilot pump 30 as absolute pressure Pgr. The pilot relief valve 32 is connected to a pilot hydraulic fluid supply line 31*b* downstream of the prime mover revolution speed detection valve 13 and generates a constant pilot pressure in the pilot hydraulic fluid supply line 31*b*. The gate lock valve 100 is connected to the pilot hydraulic fluid supply line 31*b* and connects a hydraulic fluid supply line 31*c* downstream of the gate lock valve 100 with the pilot hydraulic fluid supply line 31*b* or the tank (switching) depending on the position of a gate lock lever 24. The operating devices 122, 123, 124*a* and 124*b* (FIG. 3) include pilot valves (pressure reducing valves) which are connected to the pilot hydraulic fluid supply line 31*c* downstream of the gate lock valve 100 to generate operating pilot pressures used for controlling the flow control valves 6*a*, 6*b*, 6*c*, 6*d*, 6*e*, 6*f*, 6*g* and 6*h* (explained later).

The prime mover revolution speed detection valve 13 includes a flow rate detection valve 50 which is connected between the hydraulic fluid supply line 31*a* of the pilot pump 30 and the pilot hydraulic fluid supply line 31*b* and a differential pressure reducing valve 51 which outputs the differential pressure across the flow rate detection valve 50 as absolute pressure Pgr.

The flow rate detection valve 50 includes a variable restrictor part 50*a* whose opening area increases with the increase in the flow rate through itself (delivery flow rate of the pilot pump 30). The hydraulic fluid delivered from the pilot pump 30 passes through the variable restrictor part 50*a* of the flow rate detection valve 50 and then flows to the pilot hydraulic line 31*b*'s side. At this time, a differential pressure increasing with the increase in the flow rate occurs across the variable restrictor part 50*a* of the flow rate detection valve 50. The differential pressure reducing valve 51 outputs the differential pressure across the variable restrictor part 50*a* as the absolute pressure Pgr. Since the delivery flow rate of the pilot pump 30 changes according to the revolution speed of the prime mover 1, the delivery flow rate of the pilot pump 30 and the revolution speed of the prime mover 1 can be detected by the detection of the differential pressure across the variable restrictor part 50*a*.

The regulator 112 (first pump control unit) of the main pump 102 includes a low-pressure selection valve 112*a*, an LS control valve 112*b*, an LS control piston 112*c*, and torque control (power control) pistons 112*d*, 112*e* and 112*f*. The low-pressure selection valve 112*a* selects the lower pressure (low pressure side) from the LS differential pressure outputted by the differential pressure reducing valve 111 (absolute pressure Pls1) and the LS differential pressure outputted by the differential pressure reducing valve 211 (absolute pressure Pls2). The LS control valve 112*b* operates according to differential pressure between the selected lower LS differential pressure and the output pressure (absolute pressure) Pgr of the prime mover revolution speed detection valve 13. When the LS differential pressure is higher than the output pressure (absolute pressure) Pgr, the LS control valve 112*b* increases the output pressure by connecting its input side to the pilot hydraulic fluid supply line 31*b*. When the LS differential pressure is lower than the output pressure (absolute pressure) Pgr, the LS control valve 112*b* decreases the output pressure by connecting its input side to the tank. The LS control piston 112*c* is supplied with the output pressure of the LS control valve 112*b* and decreases the tilting (displacement) of the main pump 102 with the increase in the output pressure. The torque control (power control) piston 112*e* is supplied with the pressure in the first hydraulic fluid supply line 105 of the main pump 102 and decreases the tilting (displacement) of the main pump 102 with the increase in the pressure in the first hydraulic fluid supply line 105. The torque control (power control) piston 112*d* is supplied with the pressure in the second hydraulic fluid supply line 205 of the main pump 102 and decreases the tilting (displacement) of the main pump 102 with the increase in the pressure in the second hydraulic fluid supply line 205. The torque control (power control) piston 112*f* is supplied with the pressure in the third hydraulic fluid supply line 305 of the main pump 202 via a pressure reducing valve 112*g* and decreases the tilting (displacement) of the main pump 102 with the increase in the pressure in the third hydraulic fluid supply line 305.

The regulator 212 (second pump control unit) of the main pump 202 includes an LS control valve 212*b*, an LS control piston 212*c*, and a torque control (power control) piston 212*d*. The LS control valve 212*b* operates according to differential pressure between the LS differential pressure (absolute pressure Pls3) outputted by the differential pressure reducing valve 311 and the output pressure (absolute pressure) Pgr of the prime mover revolution speed detection valve 13. When the LS differential pressure is higher than the output pressure (absolute pressure) Pgr, the LS control valve 212*b* increases the output pressure by connecting its input side to the pilot hydraulic fluid supply line 31*b*. When the LS differential pressure is lower than the output pressure (absolute pressure) Pgr, the LS control valve 212*b* decreases the output pressure by connecting its input side to the tank. The LS control piston 212*c* is supplied with the output pressure of the LS control valve 212*b* and decreases the tilting (displacement) of the main pump 202 with the increase in the output pressure. The torque control (power control) piston 212*d* is supplied with the pressure in the third hydraulic fluid supply line 305 of the main pump 202 and decreases the tilting (displacement) of the main pump 202 with the increase in the pressure in the third hydraulic fluid supply line 305.

The low-pressure selection valve 112*a*, the LS control valve 112*b* and the LS control piston 112*c* of the regulator 112 (first pump control unit) constitute a first load sensing control unit which controls the displacement of the main pump 102 (first pump device) such that the delivery pressures of the first and second delivery ports 102*a* and 102*b* become higher by a target differential pressure than the maximum load pressure of the actuators driven by the hydraulic fluid delivered from the first and second delivery ports 102*a* and 102*b*. The LS control valve 212*b* and the LS control piston 212*c* of the regulator 212 (second pump control unit) constitute a second load sensing control unit which controls the displacement of the main pump 202 (second pump device) such that the delivery pressure of the third delivery port 202*a* becomes higher by a target differential pressure than the maximum load pressure of the actuators driven by the hydraulic fluid delivered from the third delivery port 202*a*.

The torque control pistons 112*d* and 112*e*, the pressure reducing valve 112*g* and the torque control piston 112*f* of the regulator 112 (first pump control unit) constitute a torque control unit which decreases the displacement of the main pump 102 (first pump device) with the increase in the average pressure of the delivery pressures of the first and second delivery ports 102*a* and 102*b* and decreases the displacement of the main pump 102 (first pump device) with the increase in the delivery pressure of the third delivery port 202*a*. The torque control piston 212*d* of the regulator 212 (second pump control unit) constitutes a torque control unit which decreases the displacement of the main pump 202 (second pump device) with the increase in the delivery pressure of the third delivery port 202*a*.

Figure 2A:
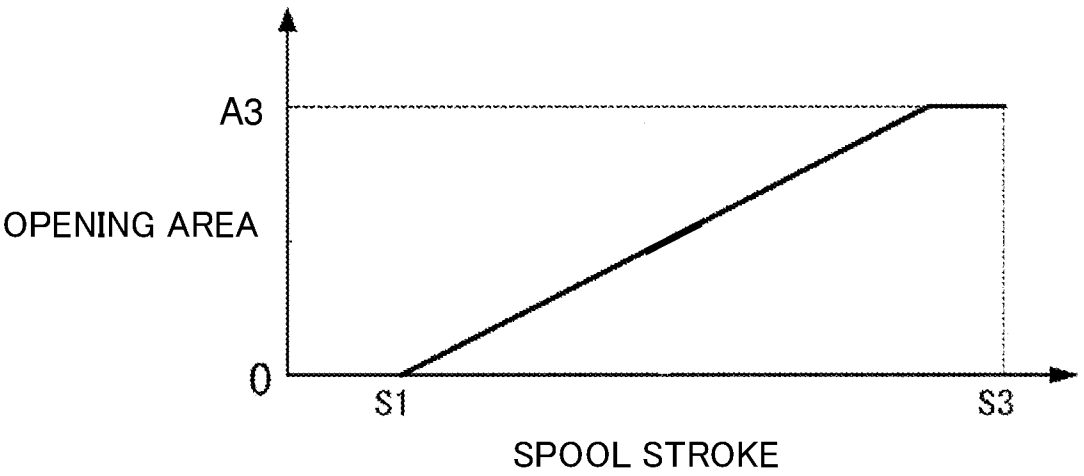
FIG. 2A is a graph showing the opening area characteristic of a meter-in channel of a flow control valve of each actuator other than a boom cylinder or an arm cylinder.

FIG. 2A is a graph showing the opening area characteristic of the meter-in channel of the flow control valve 6*c*-6*h* of each actuator 3*c*-3*h* other than the boom cylinder 3*a* or the arm cylinder 3*b*. The opening area characteristic of these flow control valves is set such that the opening area increases with the increase in the spool stroke beyond the dead zone O-S1 and the opening area reaches the maximum opening area A3 just before the spool stroke reaches the maximum spool stroke S3. The maximum opening area A3 has a specific value (size) depending on the type of each actuator.

Figure 2B:
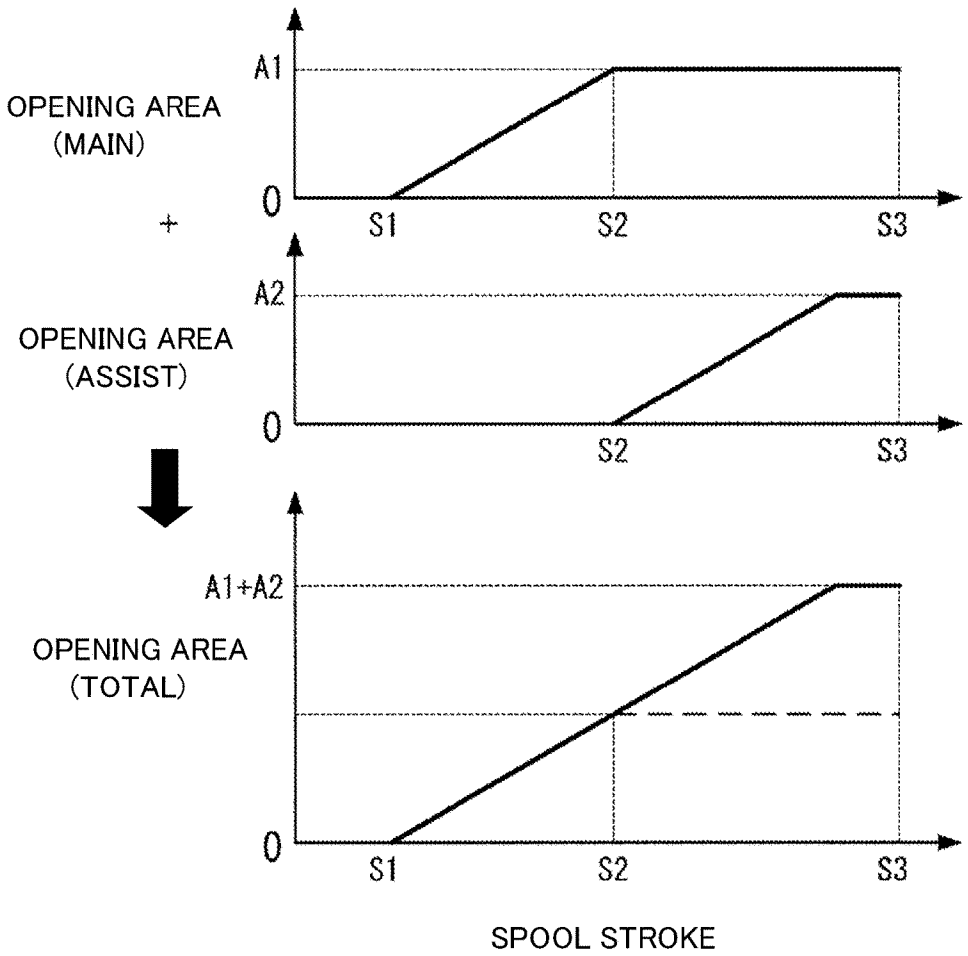
FIG. 2B is a graph showing the opening area characteristic of the meter-in channel of each of main and assist flow control valves of the boom cylinder and main and assist flow control valves of the arm cylinder (upper part) and the composite opening area characteristic of the meter-in channels of the main and assist flow control valves of the boom cylinder and the main and assist flow control valves of the arm cylinder (lower part).

The upper part of FIG. 2B shows the opening area characteristic of the meter-in channel of each of the flow control valves 6*a* and 6*i* (first and second flow control valves) of the boom cylinder 3*a* and the flow control valves 6*b* and 6*j* (third and fourth flow control valves) of the arm cylinder 3*b*.

The opening area characteristic of the flow control valve 6*a* (first flow control valve) for the main driving of the boom cylinder 3*a* is set such that the opening area increases with the increase in the spool stroke beyond the dead zone O-S1, the opening area reaches the maximum opening area A1 at an intermediate stroke S2, and thereafter the maximum opening area A1 is maintained until the spool stroke reaches the maximum spool stroke S3. The opening area characteristic of the flow control valve 6*b* (third flow control valve) for the main driving of the arm cylinder 3*b* has also been set similarly.

The opening area characteristic of the flow control valve 6*i* (second flow control valve) for the assist driving of the boom cylinder 3*a* is set such that the opening area remains at 0 until the spool stroke reaches an intermediate stroke S2, increases with the increase in the spool stroke beyond the intermediate stroke S2, and reaches the maximum opening area A2 just before the spool stroke reaches the maximum spool stroke S3. The opening area characteristic of the flow control valve 6*j* (fourth flow control valve) for the assist driving of the arm cylinder 3*b* has also been set similarly.

The lower part of FIG. 2B shows the composite opening area characteristic of the meter-in channels of the flow control valves 6*a* and 6*i* of the boom cylinder 3*a* and the flow control valves 6*b* and 6*j* of the arm cylinder 3*b*.

The meter-in channel of each flow control valve 6*a*, 6*i* of the boom cylinder 3*a* has the opening area characteristic explained above. Consequently, the meter-in channels of the flow control valves 6*a* and 6*i* of the boom cylinder 3*a* have a composite opening area characteristic in which the opening area increases with the increase in the spool stroke beyond the dead zone O-S1 and the opening area reaches the maximum opening area A1+A2 just before the spool stroke reaches the maximum spool stroke S3. The composite opening area characteristic of the meter-in channels of the flow control valves 6*b* and 6*j* of the arm cylinder 3*b* has also been set similarly.

Here, the maximum opening area A3 regarding the flow control valves 6*c*, 6*d*, 6*e*, 6*f*, 6*g* and 6*h* of the actuators 3*c*-3*h* shown in FIG. 2A and the composite maximum opening area A1+A2 regarding the flow control valves 6*a* and 6*i* of the boom cylinder 3*a* and the flow control valves 6*b* and 6*j* of the arm cylinder 3*b* satisfy a relationship A1+A2>A3. In other words, the boom cylinder 3*a* and the arm cylinder 3*b* are actuators whose maximum demanded flow rates are higher compared to the other actuators.

Further, by configuring the meter-in opening areas of the flow control valves 6*a* and 6*i* of the boom cylinder 3*a* and the flow control valves 6*b* and 6*j* of the arm cylinder 3*b* as explained above, the first delivery port 102*a* of the main pump 102 and the third delivery port 202*a* of the main pump 202 are connected to the boom cylinder 3*a* in such a manner that the boom cylinder 3*a* (first actuator) is driven only by the hydraulic fluid delivered from the third delivery port 202*a* of the single flow type main pump 202 (second pump device) when the demanded flow rate of the boom cylinder 3*a* (first actuator) is lower than a prescribed flow rate corresponding to the opening area A1 and the boom cylinder 3*a* (first actuator) is driven by the hydraulic fluid delivered from the third delivery port 202*a* of the single flow type main pump 202 (second pump device) and the hydraulic fluid delivered from the first delivery port 102*a* (one of the first and second delivery ports) of the split flow type main pump 102 (first pump device) merged together when the demanded flow rate of the boom cylinder 3*a* (first actuator) is higher than the prescribed flow rate corresponding to the opening area A1. Further, the first and second delivery ports 102*a* and 102*b* of the main pump 102 are connected to the arm cylinder 3*b* in such a manner that the arm cylinder 3*b* (second actuator) is driven only by the hydraulic fluid delivered from the second delivery port 102*b* (the other one of the first and second delivery ports) of the split flow type main pump 102 (first pump device) when the demanded flow rate of the arm cylinder 3*b* (second actuator) is lower than a prescribed flow rate corresponding to the opening area A1 and the arm cylinder 3*b* (second actuator) is driven by the hydraulic fluids delivered from the first and second delivery ports 102*a* and 102*b* of the split flow type main pump 102 (first pump device) merged together when the demanded flow rate of the arm cylinder 3*b* (second actuator) is higher than the prescribed flow rate corresponding to the opening area A1.

The actuator 3*f* is the left travel motor of the hydraulic excavator, for example. The actuator 3*g* is the right travel motor of the hydraulic excavator, for example. These actuators 3*f* and 3*g* are actuators driven at the same time and achieving a prescribed function by having supply flow rates equivalent to each other when driven at the same time. In this embodiment, the first and second delivery ports 102*a* and 102*b* of the split flow type main pump 102 (first pump device) are connected to the left and right travel motors 3*f* and 3*g* (third and fourth actuators) in such a manner that the left travel motor 3*f* (third actuator) is driven by the hydraulic fluid delivered from the first delivery port 102*a* (one of the first and second delivery ports) of the split flow type main pump 102 (first pump device) and the right travel motor 3*g* (fourth actuator) is driven by the hydraulic fluid delivered from the second delivery port 102*b* (the other one of the first and second delivery ports) of the split flow type main pump 102 (first pump device).

FIG. 3 is a schematic diagram showing the external appearance of the hydraulic excavator in which the hydraulic drive system explained above is installed.

Referring to FIG. 3, the hydraulic excavator (well known as an example of a work machine) comprises a lower track structure 101, an upper swing structure 109, and a front work implement 104 of the swinging type. The front work implement 104 is made up of a boom 104*a*, an arm 104*b* and a bucket 104*c*. The upper swing structure 109 can be rotated (swung) with respect to the lower track structure 101 by a swing motor 3*c*. A swing post 103 is attached to the front of the upper swing structure 109. The front work implement 104 is attached to the swing post 103 to be movable vertically. The swing post 103 can be rotated (swung) horizontally with respect to the upper swing structure 109 by the expansion and contraction of the swing cylinder 3*e*. The boom 104*a*, the arm 104*b* and the bucket 104*c* of the front work implement 104 can be rotated vertically by the expansion and contraction of the boom cylinder 3*a*, the arm cylinder 3*b* and the bucket cylinder 3*d*, respectively. A blade 106 which is moved vertically by the expansion and contraction of the blade cylinder 3*h* is attached to a center frame of the lower track structure 101. The lower track structure 101 carries out the traveling of the hydraulic excavator by driving left and right crawlers 101*a* and 101*b* with the rotation of the travel motors 3*f* and 3*g*.

The upper swing structure 109 is provided with a cab 108 of the canopy type. Arranged in the cab 108 are a cab seat 121, the left and right front/swing operating devices 122 and 123 (only the left side is shown in FIG. 3), the travel operating devices 124*a* and 124*b* (only the left side is shown in FIG. 3), a swing operating device (not shown), a blade operating device (not shown), the gate lock lever 24, and so forth. The control lever of each of the operating devices 122 and 123 can be operated in any direction with reference to the cross-hair directions from its neutral position. When the control lever of the left operating device 122 is operated in the longitudinal direction, the operating device 122 functions as an operating device for the swinging. When the control lever of the left operating device 122 is operated in the transverse direction, the operating device 122 functions as an operating device for the arm. When the control lever of the right operating device 123 is operated in the longitudinal direction, the operating device 123 functions as an operating device for the boom. When the control lever of the right operating device 123 is operated in the transverse direction, the operating device 123 functions as an operating device for the bucket.

Operation

Next, the operation of this embodiment will be explained below.

First, the hydraulic fluid delivered from the fixed displacement pilot pump 30 driven by the prime mover 1 is supplied to the hydraulic fluid supply line 31*a*. The hydraulic fluid supply line 31*a* is equipped with the prime mover revolution speed detection valve 13. The prime mover revolution speed detection valve 13 uses the flow rate detection valve 50 and the differential pressure reducing valve 51 and thereby outputs the differential pressure across the flow rate detection valve 50 (which changes according to the delivery flow rate of the pilot pump 30) as the absolute pressure Pgr. The pilot relief valve 32 connected downstream of the prime mover revolution speed detection valve 13 generates a constant pressure in the pilot hydraulic fluid supply line 31*b*.

(a) When all Control Levers are at Neutral Positions

All the flow control valves 6*a*-6*j* are positioned at their neutral positions since the control levers of all the operating devices are at their neutral positions. Since all the flow control valves 6*a*-6*j* are at their neutral positions, the first load pressure detection circuit 131, the second load pressure detection circuit 132 and the third load pressure detection circuit 133 detect the tank pressure as the maximum load pressures Plmax1, Plmax2 and Plmax3, respectively. These maximum load pressures Plmax1, Plmax2 and Plmax3 are led to the unload valves 115, 215 and 315 and the differential pressure reducing valves 111, 211 and 311, respectively.

Due to the maximum load pressure Plmax1, Plmax2, Plmax3 led to each unload valve 115, 215, 315, the pressure P1, P2, P3 in each of the first, second and third hydraulic fluid supply lines 105, 205 and 305 is maintained at a pressure (unload valve set pressure) as the sum of the maximum load pressure Plmax1, Plmax2, Plmax3 and the set pressure Pun0 of the spring of each unload valve 115, 215, 315. In this case, the maximum load pressures Plmax1, Plmax2 and Plmax3 equal the tank pressure as mentioned above. Assuming that the tank pressure is approximately 0 MPa, the unload valve set pressure equals the set pressure Pun0 of the spring, and the pressures P1, P2 and P3 in the first, second and third hydraulic fluid supply lines 105, 205 and 305 are maintained at Pun0. In general, the set pressure Pun0 of the spring is set slightly higher than the output pressure Pgr of the prime mover revolution speed detection valve 13 (Pun0>Pgr).

Each differential pressure reducing valve 111, 211, 311 outputs the differential pressure (LS differential pressure) between the pressure P1, P2, P3 in each of the first, second and third hydraulic fluid supply lines 105, 205 and 305 and the maximum load pressure Plmax1, Plmax2, Plmax3 (tank pressure) as the absolute pressure Pls1, Pls2, Pls3. Since the maximum load pressures Plmax1, Plmax2 and Plmax3 equal the tank pressure as mentioned above, the following relationships hold:

$$Pls1=P1-Pl\max1=P1=Pun0>Pgr$$

$$Pls2=P2-Pl\max2=P2=Pun0>Pgr$$

$$Pls3=P3-Pl\max3=P3=Pun0>Pgr$$

The absolute pressures Pls1 and Pls2 as the LS differential pressures are led to the low-pressure selection valve 112*a* of the regulator 112, while the absolute pressure Pls3 is led to the LS control valve 212*b* of the regulator 212.

In the regulator 112, the lower pressure (low pressure side) is selected from the LS differential pressures Pls1 and Pls2 led to the low-pressure selection valve 112*a* and the selected lower pressure is led to the LS control valve 112*b*. In this case, irrespective of which of Pls1 or Pls2 is selected, Pls1 or Pls2>Pgr holds, and thus the LS control valve 112*b* is pushed leftward in FIG. 1 and switched to the right-hand position. At the right-hand position, the LS control valve 112*b* leads the constant pilot pressure generated by the pilot relief valve 32 to the LS control piston 112*c*. Since the hydraulic fluid is led to the LS control piston 112*c*, the displacement of the main pump 102 is maintained at the minimum level.

Meanwhile, the LS differential pressure Pls3 is led to the LS control valve 212*b* of the regulator 212. Since Pls3>Pgr holds, the LS control valve 212*b* is pushed rightward in FIG. 1 and switched to the left-hand position. At the left-hand position, the LS control valve 212*b* leads the constant pilot pressure generated by the pilot relief valve 32 to the LS control piston 212*c*. Since the hydraulic fluid is led to the LS control piston 212*c*, the displacement of the main pump 202 is maintained at the minimum level.

(b) When Boom Control Lever is Operated (Fine Operation)

When the control lever of the boom operating device (boom control lever) is operated in the direction of expanding the boom cylinder 3*a* (i.e., boom raising direction), for example, the flow control valves 6*a* and 6*i* for driving the boom cylinder 3*a* are switched upward in FIG. 1. As explained referring to FIG. 2B, the opening area characteristics of the flow control valves 6*a* and 6*i* for driving the boom cylinder 3*a* have been set so as to use the flow control valve 6*a* for the main driving and the flow control valve 6*i* for the assist driving. The flow control valves 6*a* and 6*i* stroke according to the operating pilot pressure outputted by the pilot valve of the operating device.

When the operation on the boom control lever is a fine operation and the strokes of the flow control valves 6*a* and 6*i* are within S2 shown in FIG. 2B, the opening area of the meter-in channel of the flow control valve 6*a* for the main driving increases gradually from 0 to A1 with the increase in the operation amount (operating pilot pressure) of the boom control lever. On the other hand, the opening area of the meter-in channel of the flow control valve 6*i* for the assist driving is maintained at 0.

Therefore, when the flow control valve 6*a* is switched upward in FIG. 1, the load pressure on the bottom side of the boom cylinder 3*a* is detected by the third load pressure detection circuit 133 as the maximum load pressure Plmax3 via the load port of the flow control valve 6*a* and is led to the unload valve 315 and the differential pressure reducing valve 311. Due to the maximum load pressure Plmax3 led to the unload valve 315, the set pressure of the unload valve 315 rises to a pressure as the sum of the maximum load pressure Plmax3 (the load pressure on the bottom side of the boom cylinder 3*a*) and the set pressure Pun0 of the spring, by which the hydraulic line for discharging the hydraulic fluid in the third hydraulic fluid supply line 305 to the tank is interrupted. Further, due to the maximum load pressure Plmax3 led to the differential pressure reducing valve 311, the differential pressure (LS differential pressure) between the pressure P3 in the third hydraulic fluid supply line 305 and the maximum load pressure Plmax3 is outputted by the differential pressure reducing valve 311 as the absolute pressure Pls3. The absolute pressure (LS differential pressure) Pls3 is led to the LS control valve 212*b*. The LS control valve 212*b* compares the absolute pressure (LS differential pressure) Pls3 with the output pressure Pgr of the prime mover revolution speed detection valve 13 (target LS differential pressure).

Just after the control lever is operated (lever input) at the start of the boom raising operation, the load pressure of the boom cylinder 3*a* is transmitted to the third hydraulic fluid supply line 305 and the pressure difference between two lines becomes almost 0, and thus the absolute pressure Pls3 as the LS differential pressure becomes almost equal to 0. Since the relationship Pls3<Pgr holds, the LS control valve 212*b* switches leftward in FIG. 1 and discharges the hydraulic fluid in the LS control piston 212*c* to the tank. Accordingly, the displacement (flow rate) of the main pump 202 gradually increases and the increase in the flow rate continues until Pls3=Pgr is satisfied. Consequently, the hydraulic fluid at the flow rate corresponding to the input to the boom control lever is supplied to the bottom side of the boom cylinder 3*a*, by which the boom cylinder 3*a* is driven in the expanding direction.

Meanwhile, the first load pressure detection circuit 131 connected to the load port of the flow control valve 6*i* detects the tank pressure as the maximum load pressure Plmax1. Therefore, the delivery flow rate of the main pump 102 is maintained at the minimum level similarly to the case where all the control levers are at the neutral positions.

(c) When Boom Control Lever is Operated (Full Operation)

When the boom control lever is operated to the limit (full operation) in the direction of expanding the boom cylinder 3*a* (i.e., boom raising direction), for example, the flow control valves 6*a* and 6*i* for driving the boom cylinder 3*a* are switched upward in FIG. 1. As shown in FIG. 2B, the spool strokes of the flow control valves 6*a* and 6*i* exceed S2, the opening area of the meter-in channel of the flow control valve 6*a* is maintained at A1, and the opening area of the meter-in channel of the flow control valve 6*i* reaches A2.

As mentioned above, according to the load pressure on the bottom side of the boom cylinder 3*a* detected via the flow control valve 6*a*, the flow rate of the main pump 202 is controlled such that Pls3 equals Pgr, and the hydraulic fluid at the flow rate corresponding to the input to the boom control lever is supplied from the main pump 202 to the bottom side of the boom cylinder 3*a*.

Meanwhile, the load pressure on the bottom side of the boom cylinder 3*a* is detected by the first load pressure detection circuit 131 as the maximum load pressure Plmax1 via the load port of the flow control valve 6*i* and is led to the unload valve 115 and the differential pressure reducing valve 111. Due to the maximum load pressure Plmax1 led to the unload valve 115, the set pressure of the unload valve 115 rises to a pressure as the sum of the maximum load pressure Plmax1 (the load pressure on the bottom side of the boom cylinder 3*a*) and the set pressure Pun0 of the spring, by which the hydraulic line for discharging the hydraulic fluid in the first hydraulic fluid supply line 105 to the tank is interrupted. Further, due to the maximum load pressure Plmax1 led to the differential pressure reducing valve 111, the differential pressure (LS differential pressure) between the pressure P1 in the first hydraulic fluid supply line 105 and the maximum load pressure Plmax1 is outputted by the differential pressure reducing valve 111 as the absolute pressure Pls1. The absolute pressure (LS differential pressure) Pls1 is led to the low-pressure selection valve 112*a* of the regulator 112, and the lower pressure (low pressure side) is selected from Pls1 and Pls2 by the low-pressure selection valve 112*a*.

Just after the control lever is operated (lever input) at the start of the boom raising operation, the load pressure of the boom cylinder 3*a* is transmitted to the first hydraulic fluid supply line 105 and the pressure difference between two lines becomes almost 0, and thus the absolute pressure Pls1 as the LS differential pressure becomes almost equal to 0. On the other hand, the LS differential pressure Pls2 has been maintained at a level higher than Pgr in this case (Pls2=P2−Plmax2=P2=Pun0>Pgr) similarly to the case where the control lever is at the neutral position. Thus, the LS differential pressure Pls1 is selected as the lower pressure by the low-pressure selection valve 112*a* and is led to the LS control valve 112*b*. The LS control valve 112*b* compares the LS differential pressure Pls1 with the output pressure Pgr of the prime mover revolution speed detection valve 13 (target LS differential pressure). In this case, the LS differential pressure Pls1 is almost equal to 0 as mentioned above and the relationship Pls1<Pgr holds. Therefore, the LS control valve 112*b* switches rightward in FIG. 1 and discharges the hydraulic fluid in the LS control piston 112*c* to the tank. Accordingly, the displacement (flow rate) of the main pump 102 gradually increases and the increase in the flow rate continues until Pls1=Pgr is satisfied. Consequently, the hydraulic fluid at the flow rate corresponding to the input to the boom control lever is supplied from the first delivery port 102*a* of the main pump 102 to the bottom side of the boom cylinder 3*a*, and the boom cylinder 3*a* is driven in the expanding direction by the merged hydraulic fluid from the third delivery port 202*a* of the main pump 202 and the first delivery port 102*a* of the main pump 102.

In this case, the second hydraulic fluid supply line 205 is supplied with the hydraulic fluid at the same flow rate as the hydraulic fluid supplied to the first hydraulic fluid supply line 105, and the hydraulic fluid supplied to the second hydraulic fluid supply line 205 is returned to the tank as a surplus flow via the unload valve 215. At this time, the second load pressure detection circuit 132 is detecting the tank pressure as the maximum load pressure Plmax2, and thus the set pressure of the unload valve 215 becomes equal to the set pressure Pun0 of the spring and the pressure P2 in the second hydraulic fluid supply line 205 is maintained at the low pressure Pun0. Accordingly, the pressure loss occurring in the unload valve 215 when the surplus flow returns to the tank is reduced and operation with less energy loss is made possible.

(d) When Arm Control Lever is Operated (Fine Operation)

When the control lever of the arm operating device (arm control lever) is operated in the direction of expanding the arm cylinder 3*b* (i.e., arm crowding direction), for example, the flow control valves 6*b* and 6*j* for driving the arm cylinder 3*b* are switched downward in FIG. 1. As explained referring to FIG. 2B, the opening area characteristics of the flow control valves 6*b* and 6*j* for driving the arm cylinder 3*b* have been set so as to use the flow control valve 6*b* for the main driving and the flow control valve 6*j* for the assist driving. The flow control valves 6*b* and 6*j* stroke according to the operating pilot pressure outputted by the pilot valve of the operating device.

When the operation on the arm control lever is a fine operation and the strokes of the flow control valves 6*b* and 6*j* are within S2 shown in FIG. 2B, the opening area of the meter-in channel of the flow control valve 6*b* for the main driving increases gradually from 0 to A1 with the increase in the operation amount (operating pilot pressure) of the arm control lever. On the other hand, the opening area of the meter-in channel of the flow control valve 6*j* for the assist driving is maintained at 0.

Therefore, when the flow control valve 6*b* is switched downward in FIG. 1, the load pressure on the bottom side of the arm cylinder 3*b* is detected by the second load pressure detection circuit 132 as the maximum load pressure Plmax2 via the load port of the flow control valve 6*b* and is led to the unload valve 215 and the differential pressure reducing valve 211. Due to the maximum load pressure Plmax2 led to the unload valve 215, the set pressure of the unload valve 215 rises to a pressure as the sum of the maximum load pressure Plmax2 (the load pressure on the bottom side of the arm cylinder 3*b*) and the set pressure Pun0 of the spring, by which the hydraulic line for discharging the hydraulic fluid in the second hydraulic fluid supply line 205 to the tank is interrupted. Further, due to the maximum load pressure Plmax2 led to the differential pressure reducing valve 211, the differential pressure (LS differential pressure) between the pressure P2 in the second hydraulic fluid supply line 205 and the maximum load pressure Plmax2 is outputted by the differential pressure reducing valve 211 as the absolute pressure Pls2. The absolute pressure (LS differential pressure) Pls2 is led to the low-pressure selection valve 112*a* of the regulator 112, and the lower pressure (low pressure side) is selected from the LS differential pressures Pls1 and Pls2 by the low-pressure selection valve 112*a*

Just after the control lever is operated (lever input) at the start of the arm crowding operation, the load pressure of the arm cylinder 3*b* is transmitted to the second hydraulic fluid supply line 205 and the pressure difference between two lines becomes almost 0, and thus the absolute pressure Pls2 as the LS differential pressure becomes almost equal to 0. On the other hand, the LS differential pressure Pls1 has been maintained at a level higher than Pgr in this case (Pls1=P1−Plmax1=P1=Pun0>Pgr) similarly to the case where the control lever is at the neutral position. Thus, the LS differential pressure Pls2 is selected as the lower pressure by the low-pressure selection valve 112*a* and is led to the LS control valve 112*b*. The LS control valve 112*b* compares the LS differential pressure Pls2 with the output pressure Pgr of the prime mover revolution speed detection valve 13 (target LS differential pressure). In this case, the LS differential pressure Pls2 is almost equal to 0 as mentioned above and the relationship Pls2<Pgr holds. Therefore, the LS control valve 112*b* switches rightward in FIG. 1 and discharges the hydraulic fluid in the LS control piston 112*c* to the tank. Accordingly, the displacement (flow rate) of the main pump 102 gradually increases and the increase in the flow rate continues until Pls2=Pgr is satisfied. Consequently, the hydraulic fluid at the flow rate corresponding to the input to the arm control lever is supplied from the second delivery port 102*b* of the main pump 102 to the bottom side of the arm cylinder 3*b*, by which the arm cylinder 3*b* is driven in the expanding direction.

In this case, the first hydraulic fluid supply line 105 is supplied with the hydraulic fluid at the same flow rate as the hydraulic fluid supplied to the second hydraulic fluid supply line 205, and the hydraulic fluid supplied to the first hydraulic fluid supply line 105 is returned to the tank as a surplus flow via the unload valve 115. At this time, the first load pressure detection circuit 131 detects the tank pressure as the maximum load pressure Plmax1, and thus the set pressure of the unload valve 115 becomes equal to the set pressure Pun0 of the spring and the pressure P1 in the first hydraulic fluid supply line 105 is maintained at the low pressure Pun0. Accordingly, the pressure loss occurring in the unload valve 115 when the surplus flow returns to the tank is reduced and operation with less energy loss is made possible.

(e) When Arm Control Lever is Operated (Full Operation)

When the arm control lever is operated to the limit (full operation) in the direction of expanding the arm cylinder 3*b* (i.e., arm crowding direction), for example, the flow control valves 6*b* and 6*j* for driving the arm cylinder 3*b* are switched downward in FIG. 1. As shown in FIG. 2B, the spool strokes of the flow control valves 6*b* and 6*j* exceed S2, the opening area of the meter-in channel of the flow control valve 6*b* is maintained at A1, and the opening area of the meter-in channel of the flow control valve 6*j* reaches A2.

As explained in the above chapter (d), the load pressure on the bottom side of the arm cylinder 3*b* is detected by the second load pressure detection circuit 132 as the maximum load pressure Plmax2 via the load port of the flow control valve 6*b*, and the hydraulic line for discharging the hydraulic fluid in the second hydraulic fluid supply line 205 to the tank is interrupted by the unload valve 215. Further, due to the maximum load pressure Plmax2 led to the differential pressure reducing valve 211, the absolute pressure Pls2 as the LS differential pressure is outputted and led to the low-pressure selection valve 112*a* of the regulator 112.

Meanwhile, the load pressure on the bottom side of the arm cylinder 3*b* is detected by the first load pressure detection circuit 131 as the maximum load pressure Plmax1 (=Plmax2) via the load port of the flow control valve 6*j* and is led to the unload valve 115 and the differential pressure reducing valve 111. Due to the maximum load pressure Plmax1 led thereto, the unload valve 115 interrupts the hydraulic line for discharging the hydraulic fluid in the first hydraulic fluid supply line 105 to the tank. Further, due to the maximum load pressure Plmax1 led to the differential pressure reducing valve 111, the absolute pressure Pls1 (=Pls2) as the LS differential pressure is led to the low-pressure selection valve 112*a* of the regulator 112.

Just after the control lever is operated (lever input) at the start of the arm crowding operation, the load pressure of the arm cylinder 3*b* is transmitted to the first and second hydraulic fluid supply lines 105 and 205 and the pressure difference between two lines becomes almost 0, and thus the absolute pressures Pls1 and Pls2 as the LS differential pressures both become almost equal to 0. Thus, the LS differential pressure Pls1 or Pls2 is selected as the lower pressure (low pressure side) by the low-pressure selection valve 112*a* and is led to the LS control valve 112*b*. In this case, both Pls1 and Pls2 are almost equal to 0 (<Pgr) as mentioned above, and thus the LS control valve 112*b* switches rightward in FIG. 1 and discharges the hydraulic fluid in the LS control piston 112*c* to the tank. Accordingly, the displacement (flow rate) of the main pump 102 gradually increases and the increase in the flow rate continues until Pls1=Pgr or Pls2=Pgr is satisfied. Consequently, the hydraulic fluid at the flow rate corresponding to the input to the arm control lever is supplied from the first and second delivery ports 102*a* and 102*b* of the main pump 102 to the bottom side of the arm cylinder 3*b*, and the arm cylinder 3*b* is driven in the expanding direction by the merged hydraulic fluid from the first and second delivery ports 102*a* and 102*b*.

(f) When Level Smoothing Operation is Performed

The level smoothing operation is a combination of the fine operation of the boom raising and the full operation of the arm crowding. As for the movement of the actuators, the level smoothing operation is implemented by expansion of the arm cylinder 3*b* and expansion of the boom cylinder 3*a*.

The level smoothing operation includes the boom raising fine operation, and thus the opening area of the meter-in channel of the flow control valve 6*a* for the main driving of the boom cylinder 3*a* reaches A1 and the opening area of the meter-in channel of the flow control valve 6*i* for the assist driving of the boom cylinder 3*a* is maintained at 0 as explained in the chapter (b). The load pressure of the boom cylinder 3*a* is detected by the third load pressure detection circuit 133 as the maximum load pressure Plmax3 via the load port of the flow control valve 6*a*, and the hydraulic line for discharging the hydraulic fluid in the third hydraulic fluid supply line 305 to the tank is interrupted by the unload valve 315. Further, the maximum load pressure Plmax3 is fed back to the regulator 212 of the main pump 202, the displacement (flow rate) of the main pump 202 increases according to the demanded flow rate (opening area) of the flow control valve 6*a*, the hydraulic fluid at the flow rate corresponding to the input to the boom control lever is supplied from the third delivery port 202*a* of the main pump 202 to the bottom side of the boom cylinder 3*a*, and the boom cylinder 3*a* is driven in the expanding direction by the hydraulic fluid from the third delivery port 202*a*.

On the other hand, the arm control lever is operated to the limit (full operation), and thus the opening areas of the meter-in channels of the flow control valves 6*b* and 6*j* for the main driving and the assist driving of the arm cylinder 3*b* reach A1 and A2, respectively, as explained in the above chapter (e). The load pressure of the arm cylinder 3*b* is detected by the first and second load pressure detection circuits 131 and 132 respectively as the maximum load pressures Plmax1 and Plmax2 (Plmax1=Plmax2) via the load ports of the flow control valves 6*b* and 6*j*, the hydraulic line for discharging the hydraulic fluid in the first hydraulic fluid supply line 105 to the tank is interrupted by the unload valve 115, and the hydraulic line for discharging the hydraulic fluid in the second hydraulic fluid supply line 205 to the tank is interrupted by the unload valve 215. Further, the maximum load pressures Plmax1 and Plmax2 are fed back to the regulator 112 of the main pump 102, the displacement (flow rate) of the main pump 102 increases according to the demanded flow rates (opening areas) of the flow control valves 6*b* and 6*j*, the hydraulic fluid at the flow rate corresponding to the input to the arm control lever is supplied from the first and second delivery ports 102*a* and 102*b* of the main pump 102 to the bottom side of the arm cylinder 3*b*, and the arm cylinder 3*b* is driven in the expanding direction by the merged hydraulic fluid from the first and second delivery ports 102*a* and 102*b*.

In the level smoothing operation, the load pressure of the arm cylinder 3*b* is generally low and the load pressure of the boom cylinder 3*a* is generally high in many cases. In this embodiment, actuators differing in the load pressure are driven by separate pumps (the boom cylinder 3*a* is driven by the main pump 202 and the arm cylinder 3*b* is driven by the main pump 102) in the level smoothing operation. Therefore, the wasteful energy consumption caused by the pressure loss in the pressure compensating valve 7*b* on the low load side (occurring in the conventional one-pump load sensing system which drives multiple actuators differing in the load pressure by use of one pump) does not occur in the hydraulic drive system of this embodiment.

(g) Bucket Scraping Operation after Bucket Excavation

In the bucket scraping operation after bucket excavation, the arm crowding is performed in the fine operation while performing the boom raising at the maximum speed (boom raising full operation) after the bucket excavation. Since the boom raising is performed to the limit (full operation), the opening areas of the meter-in channels of the flow control valves 6*a* and 6*i* for the main driving and the assist driving of the boom cylinder 3*a* reach A1 and A2, respectively, as explained in the chapter (c). The load pressure of the boom cylinder 3*a* is detected by the first and third load pressure detection circuits 131 and 133 respectively as the maximum load pressures Plmax1 and Plmax3, the hydraulic line for discharging the hydraulic fluid in the first hydraulic fluid supply line 105 to the tank is interrupted by the unload valve 115, and the hydraulic line for discharging the hydraulic fluid in the third hydraulic fluid supply line 305 to the tank is interrupted by the unload valve 315. Further, the maximum load pressure Plmax3 is fed back to the regulator 212 of the main pump 202, the displacement (flow rate) of the main pump 202 increases according to the demanded flow rate (opening area) of the flow control valve 6*a*, and the hydraulic fluid at the flow rate corresponding to the input to the boom control lever is supplied from the third delivery port 202*a* of the main pump 202 to the bottom side of the boom cylinder 3*a*. Due to the maximum load pressures Plmax1 led to the differential pressure reducing valve 111, the absolute pressure Pls1 as the LS differential pressure is outputted and led to the low-pressure selection valve 112*a* of the regulator 112.

On the other hand, since the arm crowding is performed in the fine operation, the opening area of the meter-in channel of the flow control valve 6*j* for the assist driving is maintained at 0 and the opening area of the meter-in channel of the flow control valve 6*b* for the main driving reaches A1 as explained in the chapter (d). The load pressure of the arm cylinder 3*b* is detected by the second load pressure detection circuit 132 as the maximum load pressure Plmax2, and the hydraulic line for discharging the hydraulic fluid in the second hydraulic fluid supply line 205 to the tank is interrupted by the unload valve 215. Due to the maximum load pressures Plmax2 led to the differential pressure reducing valve 211, the absolute pressure Pls2 as the LS differential pressure is outputted and led to the low-pressure selection valve 112*a* of the regulator 112.

In the selection of the lower pressure (low pressure side) from Pls1 and Pls2 made by the low-pressure selection valve 112*a* of the regulator 112, which of Pls1 or Pls2 is selected as the low pressure side depends on the magnitude relationship between the demanded flow rate (opening area) of the flow control valve 6*i* for the assist driving of the boom cylinder 3*a* and the demanded flow rate (opening area) of the flow control valve 6*b* for the main driving of the arm cylinder 3*b*. Since the pressure in a hydraulic fluid supply line (pressure in a delivery port) on the side with the higher demanded flow rate decreases more, the LS differential pressure also decreases further. In the bucket scraping operation after bucket excavation, the boom raising is performed in the full operation and the arm crowding is performed in the fine operation, and thus the demanded flow rate of the boom control lever tends to be higher than the demanded flow rate of the arm control lever. In this case, the LS differential pressure Pls1 is on the low pressure side and selected by the low-pressure selection valve 112*a*, and the displacement (flow rate) of the main pump 102 increases according to the demanded flow rate of the flow control valve 6*i* used for the assist driving of the boom cylinder 3*a*. At this time, the delivery flow rate of the second delivery port 102*b* of the main pump 102 has also increased accordingly, and a surplus flow occurs in the second hydraulic fluid supply line 205 since the flow rate of the hydraulic fluid supplied to the bottom side of the arm cylinder 3*b* is lower than the delivery flow rate of the second delivery port 102*b*. This surplus flow is discharged to the tank via the unload valve 215. In this case, since the load pressure of the arm cylinder 3*b* is led to the unload valve 215 as the maximum load pressure Plmax2 and the load pressure of the arm cylinder 3*b* is low as mentioned above, the set pressure of the unload valve 215 has also been set low. Accordingly, when the surplus flow of the hydraulic fluid delivered from the second delivery port 102*b* is discharged to the tank via the unload valve 215, the amount of energy wastefully consumed due to the discharged hydraulic fluid is suppressed to a low level.

(h) Oblique Pulling Operation from Upper Side of Slope

A case where the main body of the hydraulic excavator is arranged horizontally on the upper side of a slope and then the tip of the bucket is moved obliquely from the downhill side toward the uphill side (upper side) of the slope (so-called "oblique pulling operation from the upper side of a slope") will be explained below.

The oblique pulling operation from the upper side of a slope is generally performed by operating the arm control lever in the arm crowding direction in the full operation (full input) while operating the boom control lever in the boom raising direction in a half operation (half input) in order to move the tip of the bucket along the slope. In short, the oblique pulling operation from the upper side of a slope is implemented by the combination of the boom raising half operation and the arm crowding full operation. With the increase in the angle of the slope, the operation amount of the boom raising tends to increase as well. The lever operation amount of the boom raising is determined by the arm angle with respect to the slope (distance between the vehicle body and the tip end of the bucket). For example, the lever operation amount of the boom raising increases at the start of the pulling in the oblique pulling operation and gradually decreases with the progress of the oblique pulling operation.

A case where the spool strokes of the flow control valves 6*a* and 6*i* for the main driving and the assist driving of the boom raising (stroking according to the boom raising half operation) are S2 or more and S3 or less in FIG. 2B at the start of the pulling in the oblique pulling operation will be considered below. In this case, the flow control valve 6*a* for the main driving of the boom raising is switched upward in FIG. 1. As explained in the chapter (b), the load pressure of the boom cylinder 3*a* is detected by the third load pressure detection circuit 133 as the maximum load pressure Plmax3, and the hydraulic line for discharging the hydraulic fluid in the third hydraulic fluid supply line 305 to the tank is interrupted by the unload valve 315. Further, the maximum load pressure Plmax3 is fed back to the regulator 212 of the main pump 202, the displacement (flow rate) of the main pump 202 increases according to the demanded flow rate (opening area) of the flow control valve 6*a*, and the hydraulic fluid at the flow rate corresponding to the input to the boom control lever is supplied from the main pump 202 to the bottom side of the boom cylinder 3*a*.

Meanwhile, the flow control valve 6*i* for the assist driving is also switched upward in FIG. 1 by the boom raising half operation, and the load pressure of the boom cylinder 3*a* is led to the shuttle valve 9*i* of the first load pressure detection circuit 131 via the flow control valve 6*i*. Further, since the arm crowding is performed in the full operation, the load pressure of the arm cylinder 3*b* is also led to the shuttle valve 9*i* via the flow control valve 6*j* and the shuttle valves 9*j*, 9*d* and 9*c* of the first load pressure detection circuit 131.

Since the load pressure of the boom cylinder 3*a* is higher than that of the arm cylinder 3*b* in the oblique pulling operation, the load pressure of the boom cylinder 3*a* is detected by the first load pressure detection circuit 131 (shuttle valve 9*i*) as the maximum load pressure Plmax1 and the hydraulic line for discharging the hydraulic fluid in the first hydraulic fluid supply line 105 to the tank is interrupted by the unload valve 115. Further, due to the maximum load pressure Plmax1 led to the differential pressure reducing valve 111, the absolute pressure Pls1 as the LS differential pressure is outputted and led to the low-pressure selection valve 112*a* of the regulator 112.

Meanwhile, the load pressure of the arm cylinder 3*b* is detected by the second load pressure detection circuit 132 as the maximum load pressure Plmax2 via the load port of the flow control valve 6*b*, and the hydraulic line for discharging the hydraulic fluid in the second hydraulic fluid supply line 205 to the tank is interrupted by the unload valve 215. Further, due to the maximum load pressure Plmax2 led to the differential pressure reducing valve 211, the absolute pressure Pls2 as the LS differential pressure is outputted and led to the low-pressure selection valve 112*a* of the regulator 112.

In the regulator 112, the lower pressure (low pressure side) is selected from the LS differential pressures Pls1 and Pls2 led to the low-pressure selection valve 112*a* and the selected lower pressure is led to the LS control valve 112*b*. The LS control valve 112*b* controls the displacement (flow rate) of the main pump 102 such that the lower one (low pressure side) of Pls1 and Pls2 becomes equal to the target LS differential pressure Pgr. The hydraulic fluid at the controlled flow rate is delivered from the main pump 102 to the first and second hydraulic fluid supply lines 105 and 205.

The hydraulic fluid delivered to the first hydraulic fluid supply line 105 is supplied to the boom cylinder 3*a* via the pressure compensating valve 7*i* and the flow control valve 6*i* and also to the arm cylinder 3*b* via the pressure compensating valve 7*j* and the flow control valve 6*j*. On the other hand, the hydraulic fluid delivered to the second hydraulic fluid supply line 205 is supplied only to the arm cylinder 3*b* via the pressure compensating valve 7*b* and the flow control valve 6*b*. Therefore, the demanded flow rate on the first hydraulic fluid supply line 105's side is higher than that on the second hydraulic fluid supply line 205's side, the LS differential pressure Pls1 is on the low pressure side (compared to the LS differential pressure Pls2) and selected by the low-pressure selection valve 112*a*, and the displacement (flow rate) of the main pump 102 increases according to the LS differential pressure Pls1 (i.e., according to the demanded flow rate of the flow control valves 6*i* and 6*j*).

Since the arm crowding is performed in the full operation, the main pump 102 is capable of supplying sufficient hydraulic fluid to the second hydraulic fluid supply line 205 without falling short of the demanded flow rate of the flow control valve 6*b* assuming that the demanded flow rates of the flow control valves 6*j* and 6*b* of the arm cylinder 3*b* are equal to each other and are also respectively equal to the delivery flow rates of the first and second delivery ports 102*a* and 102*b* of the main pump 102. However, in regard to the first hydraulic fluid supply line 105, the sum of the demanded flow rate of the flow control valve 6*i* of the boom cylinder 3*a* and the demanded flow rate of the flow control valve 6*j* of the arm cylinder 3*b* exceeds the delivery flow rate of the main pump 102, that is, the so-called "saturation" occurs. The saturation intensifies especially when the load pressure of the boom cylinder 3*a* is high and the pressures in the first and third hydraulic fluid supply lines 105 and 305 are high since the pressures are led to the torque control (power control) pistons 112*d* and 112*f* and the increase in the displacement of the main pump 102 is limited (i.e., the LS control is disabled) by the torque control (power control) conducted by the torque control pistons 112*d* and 112*f* so as not to exceed preset torque. In this saturation state, the LS differential pressure Pls1 drops since the pressure in the first hydraulic fluid supply line 105 cannot be maintained at the level that is the target LS differential pressure Pgr higher than the maximum load pressure Plmax1. Due to the drop in the LS differential pressure Pls1, the target differential pressures of the pressure compensating valves 7*i* and 7*j* drop. Accordingly, the pressure compensating valves 7*i* and 7*j* shift in the closing direction and share the hydraulic fluid from the first hydraulic fluid supply line 105 at the ratio between the demanded flow rates of the flow control valves 6*i* and 6*j*.

When the first hydraulic fluid supply line 105 is in the saturation state, the main pump 102 supplies the hydraulic fluid within the extent not exceeding the torque preset by the power control (without executing the load sensing control) as mentioned above, and thus the second hydraulic fluid supply line 205 is supplied with the hydraulic fluid over the demanded flow rate of the flow control valve 6*b*. Surplus hydraulic fluid supplied to the second hydraulic fluid supply line 205 is discharged to the tank by the unload valve 215.

As above, also when the arm crowding lever operation is performed with the full input and the boom raising lever operation is performed with the half input (e.g., the oblique pulling operation from the upper side of a slope), the hydraulic fluid is supplied to the boom cylinder 3*a* and the arm cylinder 3*b* exactly as intended by the operator, by which the operator is allowed to operate the hydraulic excavator (construction machine) with no feeling of strangeness.

(i) When Left and Right Travel Control Levers are Operated (Straight Traveling)

When the left and right travel control levers are operated in the forward traveling direction at equal operation amounts to perform the straight traveling, the flow control valve 6*f* for driving the left travel motor 3*f* and the flow control valve 6*g* for driving the right travel motor 3*g* are switched upward in FIG. 1. When the left and right travel control levers are operated in the full operation, the opening areas of the meter-in channels of the flow control valves 6*f* and 6*g* reach the same value A3 as shown in FIG. 2A.

In response to the switching of the flow control valves 6*f* and 6*g*, the operation detection valve 8*f* and 8*g* are also switched. In this case, however, the hydraulic fluid supplied from the hydraulic fluid supply line 31*b* to the travel combined operation detection hydraulic line 53 via the restrictor 43 is discharged to the tank since the operation detection valves 8*a*, 8*i*, 8*c*, 8*d*, 8*j*, 8*b*, 8*e* and 8*h* for the flow control valves for driving the other actuators are at the neutral positions. Therefore, the pressures for switching the first through third selector valves 40, 146 and 246 downward in FIG. 1 become equal to the tank pressure, and thus the first through third selector valves 40, 146 and 246 are held at the lower selector positions in FIG. 1 by the functions of the springs. Accordingly, the first and second hydraulic fluid supply lines 105 and 205 are interrupted (isolated from each other) and the tank pressure is led to the shuttle valve 9*g* at the downstream end of the second load pressure detection circuit 132 via the second selector valve 146 and to the shuttle valve 9*f* at the downstream end of the first load pressure detection circuit 131 via the third selector valve 246. Thus, the load pressure of the travel motor 3*f* is detected by the first load pressure detection circuit 131 as the maximum load pressure Plmax1 via the load port of the flow control valve 6*f*, the load pressure of the travel motor 3*g* is detected by the second load pressure detection circuit 132 as the maximum load pressure Plmax2 via the load port of the flow control valve 6*g*, the hydraulic line for discharging the hydraulic fluid in the first hydraulic fluid supply line 105 to the tank is interrupted by the unload valve 115, and the hydraulic line for discharging the hydraulic fluid in the second hydraulic fluid supply line 205 to the tank is interrupted by the unload valve 215. Further, due to the maximum load pressures Plmax1 and Plmax2 respectively led to the differential pressure reducing valves 111 and 211, the absolute pressures Pls1 and Pls2 as the LS differential pressures are outputted and led to the low-pressure selection valve 112*a* of the regulator 112.

In the regulator 112, the lower pressure (low pressure side) is selected from the LS differential pressures Pls1 and Pls2 led to the low-pressure selection valve 112*a* and the selected lower pressure is led to the LS control valve 112*b*. The LS control valve 112*b* controls the displacement (flow rate) of the main pump 102 such that the lower one (low pressure side) of Pls1 and Pls2 becomes equal to the target LS differential pressure Pgr.

Here, the demanded flow rates of the left and right travel motors 3*f* and 3*g* are equal to each other as mentioned above, and the main pump 102 increases its displacement (flow rate) until the flow rate reaches the level corresponding to the demanded flow rates. Accordingly, the hydraulic fluid is supplied from the first and second delivery ports 102*a* and 102*b* of the main pump 102 to the left and right travel motors 3*f* and 3*g* at the flow rates corresponding to the inputs to the travel control levers, by which the travel motors 3*f* and 3*g* are driven in the forward traveling direction. In this case, since the main pump 102 is of the split flow type and the flow rate of the hydraulic fluid supplied to the first hydraulic fluid supply line 105 and the flow rate of the hydraulic fluid supplied to the second hydraulic fluid supply line 205 are equal to each other, the left and right travel motors are constantly supplied with equal amounts of hydraulic fluid and the hydraulic excavator (construction machine) is enabled to consistently perform the straight traveling.

Further, since the pressures P1 and P2 in the first and second hydraulic fluid supply lines 105 and 205 of the main pump 102 are led respectively to the torque control (power control) pistons 112*d* and 112*e*, the power control is performed with the average pressure of the pressures P1 and P2 when the load pressure of the travel motor 3*f* or 3*g* rises. Since the left and right travel motors are supplied with equal amounts of hydraulic fluid from the first and second delivery ports 102*a* and 102*b* of the main pump 102 also in this case, the straight traveling can be conducted without causing a surplus flow in either of the first and second hydraulic fluid supply lines 105 and 205.

(j) When Travel Control Levers and Another Control Lever Such as Boom Control Lever are Operated at the Same Time When the left and right travel control levers and the boom control lever (boom raising operation) are operated at the same time, for example, the flow control valves 6*f* and 6*g* for driving the travel motors 3*f* and 3*g* and the flow control valves 6*a* and 6*i* for driving the boom cylinder 3*a* are switched upward in FIG. 1. In response to the switching of the flow control valves 6*f*, 6*g*, 6*a* and 6*i*, the operation detection valves 8*f*, 8*g*, 8*a* and 8*i* are also switched and all hydraulic lines for leading the hydraulic fluid in the travel combined operation detection hydraulic line 53 to the tank are interrupted. Accordingly, the pressure in the travel combined operation detection hydraulic line 53 becomes equal to the pressure in the pilot hydraulic fluid supply line 31*b*, the first through third selector valves 40, 146 and 246 are pushed downward in FIG. 1 and switched to the second positions, the first and second hydraulic fluid supply lines 105 and 205 are connected together, the maximum load pressure Plmax1 detected by the first load pressure detection circuit 131 is led to the shuttle valve 9*g* at the downstream end of the second load pressure detection circuit 132 via the second selector valve 146, and the maximum load pressure Plmax2 detected by the second load pressure detection circuit 132 is led to the shuttle valve 9*f* at the downstream end of the first load pressure detection circuit 131 via the third selector valve 246.

Here, when the boom control lever is operated in the fine operation and the strokes of the flow control valves 6*a* and 6*i* are within S2 shown in FIG. 2B, the opening area of the meter-in channel of the flow control valve 6*a* for the main driving gradually increases from 0 to A1, whereas the opening area of the meter-in channel of the flow control valve 6*i* for the assist driving is maintained at 0. Thus, the load pressure on the high pressure side of the travel motors 3*f* and 3*g* is detected by the first and second load pressure detection circuits 131 and 132 respectively as the maximum load pressures Plmax1 and Plmax2, the hydraulic line for discharging the hydraulic fluid in the first hydraulic fluid supply line 105 to the tank is interrupted by the unload valve 115, and the hydraulic line for discharging the hydraulic fluid in the second hydraulic fluid supply line 205 to the tank is interrupted by the unload valve 215. Further, due to the maximum load pressures Plmax1 and Plmax2 respectively led to the differential pressure reducing valves 111 and 211, the absolute pressures Pls1 and Pls2 as the LS differential pressures are outputted and led to the low-pressure selection valve 112*a* of the regulator 112.

In the regulator 112, the lower pressure (low pressure side) is selected from the LS differential pressures Pls1 and Pls2 led to the low-pressure selection valve 112*a* and the selected lower pressure is led to the LS control valve 112*b*. The LS control valve 112*b* controls the displacement (flow rate) of the main pump 102 such that the lower one (low pressure side) of Pls1 and Pls2 becomes equal to the target LS differential pressure Pgr. The hydraulic fluid at the controlled flow rate is delivered from the main pump 102 to the first and second hydraulic fluid supply lines 105 and 205. In this case, the first selector valve 40 has switched to the second position and connected the first and second hydraulic fluid supply lines 105 and 205 together. Therefore, the first and second delivery ports 102*a* and 102*b* function as one pump, the hydraulic fluids delivered from the first and second delivery ports 102*a* and 102*b* of the main pump 102 merge together, and the merged hydraulic fluid is supplied to the left and right travel motors 3*f* and 3*g* via the pressure compensating valves 7*f* and 7*g* and the flow control valves 6*f* and 6*g*.

In this case, since the boom control lever is operated in the fine operation, the opening area of the meter-in channel of the flow control valve 6*a* for the main driving of the boom cylinder 3*a* reaches A1 and the opening area of the meter-in channel of the flow control valve 6*i* for the assist driving of the boom cylinder 3*a* is maintained at 0 as explained in the chapter (b). The load pressure of the boom cylinder 3*a* is detected by the third load pressure detection circuit 133 as the maximum load pressure Plmax3 via the load port of the flow control valve 6*a*, and the hydraulic line for discharging the hydraulic fluid in the third hydraulic fluid supply line 305 to the tank is interrupted by the unload valve 315. Further, the maximum load pressure Plmax3 is fed back to the regulator 212 of the main pump 202, the displacement (flow rate) of the main pump 202 increases according to the demanded flow rate (opening area) of the flow control valve 6*a*, and the hydraulic fluid at the flow rate corresponding to the input to the boom control lever is supplied from the third delivery port 202*a* of the main pump 202 to the bottom side of the boom cylinder 3*a*.

On the other hand, when the boom control lever is operated to the limit (full operation) in the combined operation of the traveling and the boom and the opening areas of the flow control valves 6*a* and 6*i* have reached A1 and A2 shown in FIG. 2B, the load pressure on the high pressure side of the boom cylinder 3*a* and the travel motors 3*f* and 3*g* is detected by the first and second load pressure detection circuits 131 and 132 respectively as the maximum load pressures Plmax1 and Plmax2, the hydraulic line for discharging the hydraulic fluid in the first hydraulic fluid supply line 105 to the tank is interrupted by the unload valve 115, and the hydraulic line for discharging the hydraulic fluid in the second hydraulic fluid supply line 205 to the tank is interrupted by the unload valve 215. The differential pressure reducing valves 111 and 211 respectively output the LS differential pressures Pls1 and Pls2 to the regulator 112, in which the lower pressure (low pressure side) is selected from Pls1 and Pls2 by the low-pressure selection valve 112*a* and led to the LS control valve 112*b*.

In the regulator 112, the lower pressure (low pressure side) is selected from the LS differential pressures Pls1 and Pls2 led to the low-pressure selection valve 112*a* and the selected lower pressure is led to the LS control valve 112*b*. The LS control valve 112*b* controls the displacement (flow rate) of the main pump 102 such that the lower one (low pressure side) of Pls1 and Pls2 becomes equal to the target LS differential pressure Pgr. The hydraulic fluid at the controlled flow rate is delivered from the main pump 102 to the first and second hydraulic fluid supply lines 105 and 205.

Also in this case, the hydraulic fluids delivered from the first and second delivery ports 102*a* and 102*b* of the main pump 102 merge together and the merged hydraulic fluid is supplied to the left and right travel motors 3*f* and 3*g* via the pressure compensating valves 7*f* and 7*g* and the flow control valves 6*f* and 6*g*. Meanwhile, part of the merged hydraulic fluid is supplied also to the bottom side of the boom cylinder 3*a* via the pressure compensating valve 7*i* and the flow control valve 6*i*. On the other hand, the regulator 212 of the main pump 202 operates similarly to the case where the boom control lever is operated in the fine operation, and thus the hydraulic fluid is supplied to the bottom side of the boom cylinder 3*a* also from the main pump 202.

In such a combined operation of driving the travel motors and the boom cylinder at the same time, the first and second delivery ports 102*a* and 102*b* of the main pump 102 function as one pump and the hydraulic fluids from the two delivery ports 102*a* and 102*b* are merged together and supplied to the left and right travel motors 3*f* and 3*g*. When the boom control lever is operated in the fine operation, only the hydraulic fluid from the main pump 202 is supplied to the bottom side of the boom cylinder 3*a*. When the boom control lever is operated in the full operation, the hydraulic fluid from the main pump 202 and part of the merged hydraulic fluid from the main pump 102 are supplied to the bottom side of the boom cylinder 3*a*. With such features, when the control levers of the left and right travel motors are operated at equal input amounts (operation amounts), the boom cylinder can be driven at the intended speed while maintaining the straight traveling property. Consequently, excellent operability in the travel combined operation can be achieved.

While the case where the left and right travel control levers and the boom control lever (for the boom raising) are operated at the same time has been explained above, operation of the hydraulic excavator (construction machine) substantially similar to the case where the boom control lever is operated to the limit (full operation) in the combined operation of the traveling and the boom can be achieved also when the left and right travel control levers and a control lever of an actuator other than the boom cylinder are operated at the same time, except that the load pressure of the boom cylinder is not fed back to the regulator 212 of the main pump 202 and the displacement (flow rate) of the main pump 202 is maintained at the minimum level. Specifically, the first and second delivery ports 102*a* and 102*b* of the main pump 102 function as one pump, the hydraulic fluids delivered from the first and second delivery ports 102*a* and 102*b* of the main pump 102 merge together, and the merged hydraulic fluid is supplied to each actuator via respective pressure compensating valve and flow control valve. When the control levers of the left and right travel motors are operated at equal input amounts (operation amounts), the other actuator can be driven at the intended speed while maintaining the straight traveling property. Consequently, excellent travel combined operation can be achieved.

(k) Travel Steering Operation

A case where one travel control lever is operated in the full operation and the other travel control lever is operated in the half operation (so-called "steering operation") will be explained below.

When the control lever for the left travel motor 3*f* is operated in the full operation and the control lever for the right travel motor 3*g* is operated in the half operation, for example, the flow control valve 6*f* for driving the travel motor 3*f* is switched upward to the full stroke and the flow control valve 6*g* for driving the travel motor 3*g* is switched upward to a half stroke. As shown in FIG. 2A, the opening area of the meter-in channel of the flow control valve 6*f* reaches A3 and the opening area of the meter-in channel of the flow control valve 6*g* reaches an intermediate size smaller than A3 (the demanded flow rate of the left travel motor 3*f*> the demanded flow rate of the right travel motor 3*g*).

In response to the switching of the flow control valves 6*f* and 6*g*, the operation detection valves 8*f* and 8*g* are also switched. In this case, however, the hydraulic fluid supplied from the hydraulic fluid supply line 31*b* to the travel combined operation detection hydraulic line 53 via the restrictor 43 is discharged to the tank since the operation detection valves 8*a*, 8*i*, 8*c*, 8*d*, 8*j*, 8*b*, 8*e* and 8*h* for the flow control valves for driving the other actuators are at the neutral positions. Therefore, the pressures for switching the first through third selector valves 40, 146 and 246 downward in FIG. 1 become equal to the tank pressure, and thus the first through third selector valves 40, 146 and 246 are held at the lower selector positions in FIG. 1 by the functions of the springs. Accordingly, the first and second hydraulic fluid supply lines 105 and 205 are interrupted (isolated from each other) and the tank pressure is led to the shuttle valve 9*g* at the downstream end of the second load pressure detection circuit 132 via the second selector valve 146 and to the shuttle valve 9*f* at the downstream end of the first load pressure detection circuit 131 via the third selector valve 246. Thus, the load pressure of the travel motor 3*f* is detected by the first load pressure detection circuit 131 as the maximum load pressure Plmax1 via the load port of the flow control valve 6*f*, the load pressure of the travel motor 3*g* is detected by the second load pressure detection circuit 132 as the maximum load pressure Plmax2 via the load port of the flow control valve 6*g*, the hydraulic line for discharging the hydraulic fluid in the first hydraulic fluid supply line 105 to the tank is interrupted by the unload valve 115, and the hydraulic line for discharging the hydraulic fluid in the second hydraulic fluid supply line 205 to the tank is interrupted by the unload valve 215. Further, due to the maximum load pressures Plmax1 and Plmax2 respectively led to the differential pressure reducing valves 111 and 211, the absolute pressures Pls1 and Pls2 as the LS differential pressures are outputted and led to the low-pressure selection valve 112*a* of the regulator 112.

In the regulator 112, the lower pressure (low pressure side) is selected from the LS differential pressures Pls1 and Pls2 led to the low-pressure selection valve 112*a* and the selected lower pressure is led to the LS control valve 112*b*. The LS control valve 112*b* controls the displacement (flow rate) of the main pump 102 such that the lower one (low pressure side) of Pls1 and Pls2 becomes equal to the target LS differential pressure Pgr.

Here, a case where the control lever for the left travel motor 3*f* is operated in the full operation and the control lever for the right travel motor 3*g* is operated in the half operation (i.e., the hydraulic excavator widely turns rightward from the traveling direction) will be considered below. In this case, the left travel motor 3*f* operates in the manner of dragging the right travel motor 3*g* (the load pressure of the left travel motor 3*f*>the load pressure of the right travel motor 3*g*). In regard to the demanded flow rate, the relationship "the demanded flow rate of the left travel motor 3*f*>the demanded flow rate of the right travel motor 3*g*" holds.

Since the demanded flow rate of the left travel motor 3*f* is higher than that of the right travel motor 3*g* as above, the LS differential pressure Pls1 is on the low pressure side of Pls1 and Pls2 and selected by the low-pressure selection valve 112*a*, and the main pump 102 increases its displacement (flow rate) according to Pls1 until the flow rate reaches the level corresponding to the demanded flow rate of the travel motor 3*f*. As above, the first hydraulic fluid supply line 105 is supplied with the hydraulic fluid at the flow rate corresponding to the demanded flow rate of the travel motor 3*f*.

On the other hand, the second hydraulic fluid supply line 205 is supplied with the hydraulic fluid at a flow rate higher than the demanded flow rate of the travel motor 3*g*. Surplus hydraulic fluid supplied to the second hydraulic fluid supply line 205 is discharged to the tank via the unload valve 215. In this case, the set pressure of the unload valve 215 equals the maximum load pressure Plmax2 (the load pressure of the travel motor 3*g*)+ the set pressure Pun0 of the spring. As above, the pressure in the first hydraulic fluid supply line 105 is maintained by the LS control valve 112*b* at the load pressure of the travel motor 3*f*+ the target LS differential pressure, and the pressure in the second hydraulic fluid supply line 205 is maintained by the unload valve 215 at the load pressure of the travel motor 3*g*+the set pressure Pun0 of the spring (≅the load pressure of the travel motor 3*g*+the target LS differential pressure). As explained above, the pressure in the second hydraulic fluid supply line 205 becomes lower than the pressure in the first hydraulic fluid supply line 105 by the difference between the load pressure of the travel motor 3*f* and the load pressure of the travel motor 3*g*.

The main pump 102 is of the split flow type and the torque control (power control) by the torque control pistons 112*d* and 112*e* is performed according to the total pressure (average pressure) of the first and second hydraulic fluid supply lines 105 and 205. Thus, when the pressure in one hydraulic fluid supply line is lower than the pressure in the other hydraulic fluid supply line (e.g., in the travel steering operation), the total pressure (average pressure) decreases accordingly. This decreases the possibility of the flow rate limitation by the power control in comparison with the case where the left and right travel motors are driven by one pump. Consequently, the travel steering operation can be performed with no major deterioration in the working efficiency.

Effect

As described above, according to this embodiment, in combined operations driving the boom cylinder 3*a* and the arm cylinder 3*b* of the hydraulic excavator at the same time, while suppressing the wasteful energy consumption caused by the throttle pressure loss in a pressure compensating valve, a variety of flow rate balance required of the boom cylinder 3*a* and the arm cylinder 3*b* can be coped with flexibly and excellent operability in the combined operation can be achieved.

Further, an excellent straight traveling property of the hydraulic excavator can be achieved.

Furthermore, excellent steering feel can be realized in the travel steering operation of the hydraulic excavator.

Second Embodiment

Figure 4:
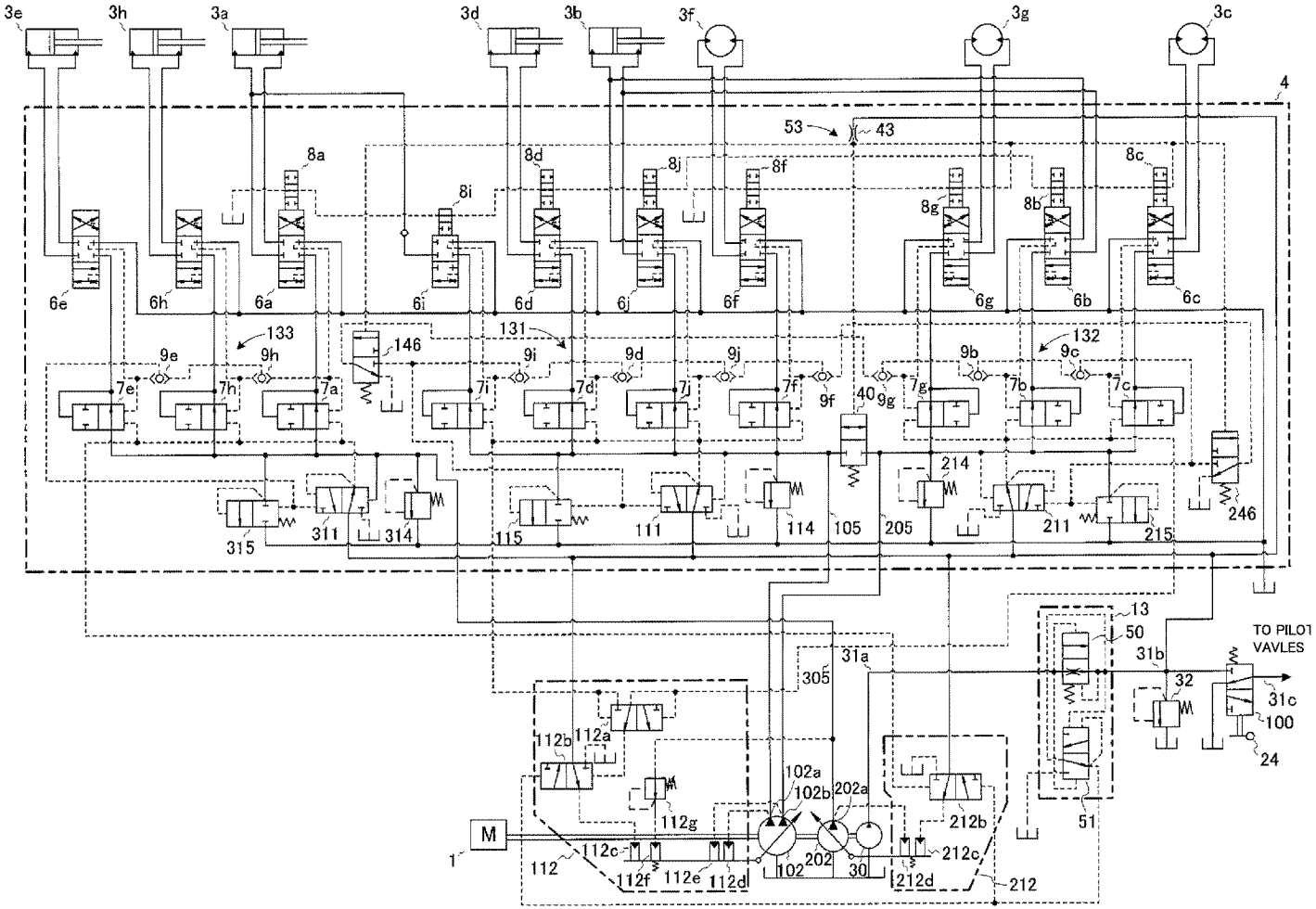
FIG. 4 is a schematic diagram showing a hydraulic drive system for a hydraulic excavator (construction machine) in accordance with a second embodiment of the present invention.

FIG. 4 is a schematic diagram showing a hydraulic drive system for a hydraulic excavator (construction machine) in accordance with a second embodiment of the present invention.

Referring to FIG. 4, the hydraulic drive system of this embodiment differs from the system in the first embodiment in that the numbers and types of the actuators connected to the first and second delivery ports 102*a* and 102*b* of the main pump 102 and the actuators connected to the third delivery port 202*a* of the main pump 202 are changed and the positions of arrangement of the corresponding pressure compensating valves and flow control valves and the shuttle valves constituting the first through third load pressure detection circuits 131-133 are changed accordingly.

Specifically, in this embodiment, the actuators connected to the third delivery port 202*a* of the main pump 202 include not only the boom cylinder 3*a* but also the swing cylinder 3*e* and the blade cylinder 3*h*. The actuators connected to the first delivery port 102*a* of the main pump 102 include the boom cylinder 3*a*, the arm cylinder 3*b*, the bucket cylinder 3*d* and the left travel motor 3*f*. The actuators connected to the second delivery port 102*b* of the main pump 102 include the arm cylinder 3*b*, the swing motor 3*c* and the right travel motor 3*g*. The boom cylinder 3*a*, the swing cylinder 3*e* and the blade cylinder 3*h* are connected to the third delivery port 202*a* of the main pump 202 respectively via the pressure compensating valves 7*a*, 7*e* and 7*h* and the flow control valves 6*a*, 6*e* and 6*h*. The boom cylinder 3*a*, the arm cylinder 3*b*, the bucket cylinder 3*d* and the left travel motor 3*f* are connected to the first delivery port 102*a* of the main pump 102 respectively via the pressure compensating valves 7*i*, 7*j*, 7*d* and 7*f* and the flow control valves 6*i*, 6*j*, 6*d* and 6*f*. The arm cylinder 3*b*, the swing motor 3*c* and the right travel motor 3*g* are connected to the second delivery port 102*b* of the main pump 102 respectively via the pressure compensating valves 7*b*, 7*c* and 7*g* and the flow control valves 6*b*, 6*c* and 6*g*. As above, in this embodiment, the swing cylinder 3*e* and the blade cylinder 3*h*, which are connected to the second delivery port 102*b* of the main pump 102 in the first embodiment, are connected to the third delivery port 202*a* of the main pump 202, and the swing motor 3*c*, which is connected to the first delivery port 102*a* of the main pump 102 in the first embodiment, is connected to the second delivery port 102*b* of the main pump 102.

Further, the first load pressure detection circuit 131 includes the shuttle valves 9*d*, 9*f*, 9*i* and 9*j* connected to the load ports of the flow control valves 6*d*, 6*f*, 6*i* and 6*j*, the second load pressure detection circuit 132 includes the shuttle valves 9*b*, 9*c* and 9*g* connected to the load ports of the flow control valves 6*b*, 6*c* and 6*g*, and the third load pressure detection circuit 133 includes the shuttle valves 9*e* and 9*h* connected to the load ports of the flow control valves 6*a*, 6*e* and 6*h*.

The rest of the structure is equivalent to that in the first embodiment.

Also in this embodiment configured as above, the connective relationship among the boom cylinder 3*a*, the third delivery port 202*a* of the main pump 202 and the first delivery port 102*a* of the main pump 102, the connective relationship among the arm cylinder 3*b* and the first and second delivery ports 102*a* and 102*b* of the main pump 102, and the connective relationship among the left and right travel motors 3*f* and 3*g* and the first and second delivery ports 102*a* and 102*b* of the main pump 102 are equivalent to those in the first embodiment. Also in this embodiment, the boom cylinder 3*a*, the arm cylinder 3*b* and the left and right travel motors 3*f* and 3*g* operate similarly to those in the first embodiment and effects similar to those in the first embodiment can be achieved.

Other Examples

While the above explanation of the embodiments has been given of cases where the construction machine is a hydraulic excavator and the first and second actuators are the boom cylinder 3*a* and the arm cylinder 3*b*, respectively, the first and second actuators can be actuators other than the boom cylinder or the arm cylinder as long as the actuators are those having greater demanded flow rates than other actuators.

While the above explanation of the embodiments has been given of cases where the third and fourth actuators are the left and right travel motors 3*f* and 3*g*, the third and fourth actuators can be actuators other than the left and right travel motors as long as the actuators are those achieving a prescribed function by having supply flow rates equivalent to each other when driven at the same time.

The present invention is applicable also to construction machines other than hydraulic excavators (e.g., hydraulic traveling cranes) as long as the construction machine comprises actuators satisfying the above-described operating condition of the first and second actuators or the third and fourth actuators.

Further, the load sensing system in the above embodiments is just an example and can be modified in various ways. For example, while the target differential pressure of the load sensing control is set in the above embodiments by arranging the differential pressure reducing valves for outputting the pump delivery pressures and the maximum load pressures as absolute pressures and leading the output pressures of the differential pressure reducing valves to the pressure compensating valves (to set a target compensation pressure) and to the LS control valves, it is also possible to lead the pump delivery pressures and the maximum load pressures to pressure control valves and LS control valves via separate hydraulic lines.

DESCRIPTION OF REFERENCE CHARACTERS

1 prime mover
102 split flow type variable displacement main pump (first pump device)
102*a*, 102*b* first and second delivery ports
112 regulator (first pump control unit)
112*a* low-pressure selection valve
112*b* LS control valve
112*c* LS control piston
112*d*, 112*e*, 112*f* torque control (power control) piston
112*g* pressure reducing valve
202 single flow type variable displacement main pump (second pump device)
202*a* third delivery port
212 regulator (second pump control unit)
212*b* LS control valve
212*c* LS control piston

212*d* torque control (power control) piston
105 first hydraulic fluid supply line
205 second hydraulic fluid supply line
305 third hydraulic fluid supply line
115 unload valve (first unload valve)
215 unload valve (second unload valve)
315 unload valve (third unload valve)
111, 211, 311 differential pressure reducing valve
146, 246 second and third selector valves
3*a*-3*h* a plurality of actuators
3*a* boom cylinder (first actuator)
3*b* arm cylinder (second actuator)
3*f*, 3*g* left and right travel motors (third and fourth actuators)
4 control valve unit
6*a*-6*j* flow control valve
7*a*-7*j* pressure compensating valve
8*a*-8*j* operation detection valve
9*b*-9*j* shuttle valve
13 prime mover revolution speed detection valve
24 gate lock lever
30 pilot pump
31*a*, 31*b*, 31*c* pilot hydraulic fluid supply line
32 pilot relief valve
40 first selector valve
53 travel combined operation detection hydraulic line
43 restrictor
100 gate lock valve
122, 123, 124*a*, 124*b* operating device
131, 132, 133 first, second and third load pressure detection circuits

The invention claimed is:

1. A hydraulic drive system for a construction machine, comprising:

a first pump device of a split flow type having a first delivery port and a second delivery port;

a second pump device of a single flow type having a third delivery port;

a plurality of actuators which are driven by hydraulic fluid delivered from the first through third delivery ports of the first and second pump devices;

a plurality of flow control valves which control a flow of the hydraulic fluid supplied from the first through third delivery ports to the actuators;

a plurality of pressure compensating valves each of which controls a differential pressure across each of the flow control valves;

a first pump control unit including a first load sensing control unit which controls a displacement of the first pump device such that a delivery pressure of a high pressure side of the first and second delivery ports becomes higher by a target differential pressure than a maximum load pressure of the actuators driven by the hydraulic fluid delivered from the first and second delivery ports; and a second pump control unit including a second load sensing control unit which controls a displacement of the second pump device such that a delivery pressure of the third delivery port becomes higher by a target differential pressure than a maximum load pressure of the actuators driven by the hydraulic fluid delivered from the third delivery port, wherein:

the plurality of actuators include first and second actuators whose maximum demanded flow rates are higher compared to the other actuators, and the first delivery port of the first pump device and the third delivery port of the second pump device are connected to the first actuator in such a manner that the first actuator is driven only by the hydraulic fluid delivered from the third delivery port of the single flow type second pump device when the demanded flow rate of the first actuator is lower than a first prescribed flow rate and the first actuator is driven by the hydraulic fluid delivered from the third delivery port of the single flow type second pump device and the hydraulic fluid delivered from one of the first and second delivery ports of the split flow type first pump device merged together when the demanded flow rate of the first actuator is higher than the first prescribed flow rate, and the first and second delivery ports of the first pump device are connected to the second actuator in such a manner that the second actuator is driven only by the hydraulic fluid delivered from the other one of the first and second delivery ports of the split flow type first pump device when the demanded flow rate of the second actuator is lower than a second prescribed flow rate and the second actuator is driven by the hydraulic fluids delivered from the first and second delivery ports of the split flow type first pump device merged together when the demanded flow rate of the second actuator is higher than the second prescribed flow rate.

2. The hydraulic drive system for a construction machine according to claim 1, wherein:

the split flow type first pump device is configured to deliver the hydraulic fluid from the first and second delivery ports at flow rates equal to each other, and the plurality of actuators include third and fourth actuators driven at the same time and achieving a prescribed function by having supply flow rates equivalent to each other when driven at the same time, and the first and second delivery ports of the first pump device are connected to the third and fourth actuators in such a manner that the third actuator is driven by the hydraulic fluid delivered from one of the first and second delivery ports of the split flow type first pump device and the fourth actuator is driven by the hydraulic fluid delivered from the other one of the first and second delivery ports of the split flow type first pump device.

3. The hydraulic drive system for a construction machine according to claim 2, wherein:

the first pump control unit includes a first torque control actuator to which the delivery pressure of the first delivery port of the split flow type first pump device is led and a second torque control actuator to which the delivery pressure of the second delivery port of the split flow type first pump device is led whereby the first pump control unit decreases the displacement of the first pump device with an increase in an average pressure of the delivery pressures of the first and second delivery ports.

4. The hydraulic drive system for a construction machine according to claim 2 or 3, further comprising:

a selector valve which is connected between a first hydraulic fluid supply line connected to the first delivery port of the split flow type first pump device and a second hydraulic fluid supply line connected to the second delivery port of the split flow type first pump device and is switched to a communication position when the third and fourth actuators and another actuator driven by the split flow type first pump device are driven at the same time and to an interruption position at the other time.

5. The hydraulic drive system for a construction machine according to claim 1, wherein:

the plurality of flow control valves include a first flow control valve which is arranged in a hydraulic line connecting a third hydraulic fluid supply line connected to the third delivery port of the second pump device to the first actuator, a second flow control valve which is arranged in a hydraulic line connecting a first hydraulic fluid supply line connected to the first delivery port of the first pump device to the first actuator, a third flow control valve which is arranged in a hydraulic line connecting a second hydraulic fluid supply line connected to the second delivery port of the first pump device to the second actuator, and a fourth flow control valve which is arranged in a hydraulic line connecting the first hydraulic fluid supply line connected to the first delivery port of the first pump device to the second actuator, the first and third flow control valves each have an opening area characteristic set such that an opening area increases with an increase in a spool stroke, the opening area reaches a maximum opening area at an intermediate stroke and thereafter the maximum opening area is maintained until the spool stroke reaches a maximum spool stroke, and the second and fourth flow control valves each have an opening area characteristic set such that an opening area remains at 0 until a spool stroke reaches an intermediate stroke, increases with an increase in the spool stroke beyond the intermediate stroke and reaches a maximum opening area just before the spool stroke reaches a maximum spool stroke.

* * * * *